US011824268B2

(12) United States Patent
Pance et al.

(10) Patent No.: US 11,824,268 B2
(45) Date of Patent: Nov. 21, 2023

(54) MULTI-RESONATOR ARRAY

(71) Applicant: ROGERS CORPORATION, Chandler, AZ (US)

(72) Inventors: Kristi Pance, Auburndale, MA (US); Shailesh Pandey, Woburn, MA (US); Gianni Taraschi, Arlington, MA (US); Sara G. Canzano, Boston, MA (US); Daniel Pennock, Salem, MA (US)

(73) Assignee: ROGERS CORPORATION, Chandler, AZ (US)

( * ) Notice: Subject to any disclaimer, the term of this patent is extended or adjusted under 35 U.S.C. 154(b) by 0 days.

(21) Appl. No.: 17/750,747

(22) Filed: May 23, 2022

(65) Prior Publication Data

US 2022/0384965 A1 Dec. 1, 2022

Related U.S. Application Data

(60) Provisional application No. 63/193,756, filed on May 27, 2021.

(51) Int. Cl.

| | |
|---|---|
| ***H01Q 21/24*** | (2006.01) |
| ***H01Q 5/307*** | (2015.01) |
| ***H01Q 9/04*** | (2006.01) |

(52) U.S. Cl.

CPC ..... *H01Q 21/24* (2013.01); *H01Q 5/307* (2015.01); *H01Q 9/0492* (2013.01)

(58) Field of Classification Search

CPC .... H01Q 9/0485; H01Q 9/0492; H01Q 5/307; H01Q 21/24; H01P 7/10

See application file for complete search history.

(56) References Cited

U.S. PATENT DOCUMENTS 6,344,833 B1 * 2/2002 Lin ..... H01Q 21/28 343/873

2005/0057402 A1 * 3/2005 Ohno ..... H01Q 21/0075 343/700 MS (Continued)

FOREIGN PATENT DOCUMENTS

CN 111786098 A * 10/2020 ..... H01P 7/10

OTHER PUBLICATIONS

Y. -D. Zhou, Y. -C. Jiao, Z. -B. Weng and T. Ni, "A Novel Single-Fed Wide Dual-Band Circularly Polarized Dielectric Resonator Antenna," in IEEE Antennas and Wireless Propagation Letters, vol. 15, pp. 930-933, 2016, doi: 10.1109/LAWP.2015.2481462. (Year: 2016).*

(Continued)

*Primary Examiner* — Ab Salam Alkassim, Jr.
*Assistant Examiner* — Leah Rosenberg
(74) *Attorney, Agent, or Firm* — CANTOR COLBURN LLP

(57) ABSTRACT

An electromagnetic, EM, apparatus includes: a unit cell having at least two dielectric resonator antennas, DRAs; wherein each one of the at least two DRAs is distinctly different from another one of the at least two DRAs; wherein each one of the at least two DRAs is not electromagnetically coupled with another one of the at least two DRAs; wherein the unit cell is configured to operate over a defined overall frequency range; wherein a first DRA of the at least two DRAs is configured to operate over a first frequency range within the overall frequency range; wherein a second DRA of the at least two DRAs is configured to operate over a second frequency range within the overall frequency range that is different from the first frequency range.

17 Claims, 23 Drawing Sheets

(56) References Cited

U.S. PATENT DOCUMENTS

| | | | | |
|---|---|---|---|---|
| 2009/0135078 | A1* | 5/2009 | Lindmark | H01Q 1/523 343/844 |
| 2018/0145400 | A1* | 5/2018 | Gabriel | H01Q 19/20 |
| 2019/0221939 | A1* | 7/2019 | George | H01Q 19/18 |
| 2020/0280133 | A1 | 9/2020 | Avser et al. | |
| 2022/0336957 | A1* | 10/2022 | Lee | H01Q 21/08 |

OTHER PUBLICATIONS

International Search Report dated Nov. 7, 2022; International Application No. PCT/US2022/030797; International Filing Dte May 25, 2022 (7 pages).

Written Opinion dated Nov. 7, 2022; International Application No. PCT/US2022/030797; International Filing Date May 25, 2022 (17 pages).

Yao-Dong Zhou et al; "A novel Single-Fed Wide Dual-Band Circularly Polarized Dielectric Resonator Antenna"; IEEE Antennas and Wireless Propagation Letters; 2015; pp. 930-933.

* cited by examiner

MULTI-RESONATOR ARRAY

CROSS REFERENCE TO RELATED APPLICATIONS

This application claims the benefit of U.S. Provisional Application Ser. No. 63/193,756, filed May 27, 2021, which is incorporated herein by reference in its entirety.

BACKGROUND

The present disclosure relates generally to an electromagnetic apparatus, and particularly to an electromagnetic apparatus in the form of a multi-resonator array.

Antenna arrays, and more particularly dielectric resonator antenna, DRA, arrays are known in the art, along with phased arrays of such antenna elements. While existing phased array antennas may be suitable for their intended purpose, there remains a need in the art of phased array antennas that provide for dual frequency, or multi-frequency, operation with different polarization modes in a compact design.

BRIEF SUMMARY

An embodiment includes an electromagnetic, EM, apparatus as defined by the appended independent claim(s). Further advantageous modifications of the EM apparatus are defined by the appended dependent claims.

In an embodiment, an electromagnetic, EM, apparatus includes: a unit cell having at least two dielectric resonator antennas, DRAs; wherein each one of the at least two DRAs is distinctly different from another one of the at least two DRAs; wherein each one of the at least two DRAs is not electromagnetically coupled with another one of the at least two DRAs; wherein the unit cell is configured to operate over a defined overall frequency range; wherein a first DRA of the at least two DRAs is configured to operate over a first frequency range within the overall frequency range; wherein a second DRA of the at least two DRAs is configured to operate over a second frequency range within the overall frequency range that is different from the first frequency range.

The above features and advantages and other features and advantages of the invention are readily apparent from the following detailed description of the invention when taken in connection with the accompanying drawings.

BRIEF DESCRIPTION OF THE DRAWINGS

Referring to the exemplary non-limiting drawings wherein like elements are numbered alike in the accompanying Figures.

Figure 1:
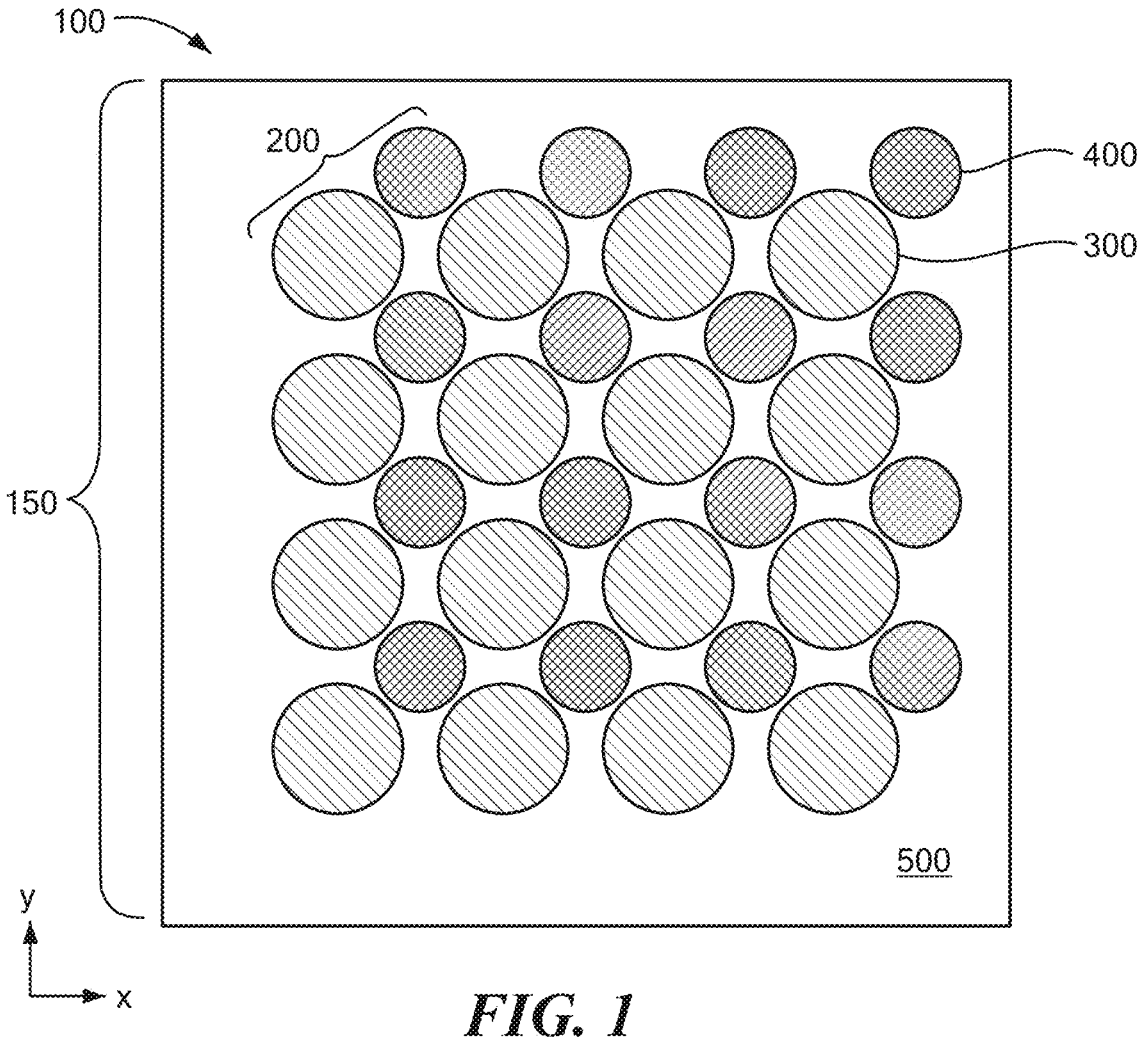
FIG. 1 depicts a top down plan view of an example EM apparatus in the form of an array of multi-resonator unit cells with paired antennas for dual frequency operation arranged within an EM reflector, in accordance with an embodiment.

One skilled in the art will understand that the drawings, further described herein below, are for illustration purposes only. It will be appreciated that for simplicity and clarity of illustration, elements shown in the figures have not necessarily been drawn to scale. For example, the dimensions or scale of some of the elements may be exaggerated relative to other elements for clarity. Further, where considered appropriate, reference numerals may be repeated among the figures to indicate corresponding or analogous elements, or analogous elements may not be repetitively enumerated in all figures where it will be appreciated and understood that such enumeration where absent is inherently disclosed.

DETAILED DESCRIPTION

As used herein, the phrase "embodiment" means "embodiment disclosed and/or illustrated herein", which may not necessarily encompass a specific embodiment of an invention in accordance with the appended claims, but nonetheless is provided herein as being useful for a complete understanding of an invention in accordance with the appended claims.

Although the following detailed description contains many specifics for the purposes of illustration, anyone of ordinary skill in the art will appreciate that many variations and alterations to the following details are within the scope of the appended claims. For example, where described features may not be mutually exclusive of and with respect to other described features, such combinations of non-mutually exclusive features are considered to be inherently disclosed herein. Additionally, common features may be commonly illustrated in the various figures but may not be specifically enumerated in all figures for simplicity, but would be recognized by one skilled in the art as being an explicitly disclosed feature even though it may not be enumerated in a particular figure. Accordingly, the following example embodiments are set forth without any loss of generality to, and without imposing limitations upon, the claimed invention disclosed herein.

An embodiment, as shown and described by the various figures and accompanying text, provides an array of multi-resonator unit cells of dielectric resonator antennas, DRAs, suitable for dual frequency band operation, and dual electromagnetic polarization operation. While the embodiments described and illustrated herein depict example first and second DRAs having particular structure, it will be appreciated that the disclosed invention is also applicable to other structural arrangements for the illustrated DRAs that definitively fall within an ambit of the appended claims. While the embodiments described and illustrated herein depict first and second DRAs of an associated unit cell for dual frequency band applications, it will be appreciated that a given unit cell may have more than two DRAs for use in multi-frequency band applications.

FIG. 1 depicts a top down plan view of an example EM apparatus 100 in the form of an array 150 of multi-resonator unit cells 200 with paired first and second antennas 300, 400 for dual frequency operation arranged within an EM reflector 500, also herein referred to as a super-substrate. As will be further described herein below, the EM reflector 500 is an electrically conductive structure having discrete cavities or pockets in which a given unit cell 200 is disposed, where the unit cell 200 is disposed on an electrically conductive surface at the bottom of the respective cavity that is electrically connected with the electrically conductive structure of the EM reflector 500. In an embodiment, each first and second antenna 300, 400 of the paired antennas is a dielectric resonator antenna, DRA, where the first DRA 300 is herein referred to as a low frequency (LF) antenna, and the second DRA 400 is herein referred to as a high frequency (HF) antenna. However, it will be appreciated that the relative terms low and high may be reversed with respect to the first and second antennas 300, 400 without detracting from a scope of the invention disclosed herein. The first and second DRAs 300, 400 are not electromagnetically coupled with each other by virtue of the EM reflector 500 and the inherent EM shielding provided therein. In an embodiment, each unit cell 200 is a duplicate of an adjacent unit cell 200 with respect to both structure and orientation, that is, each unit cell 200 has the same structure and the same orientation as an adjacent unit cell 200. In an embodiment, and as will be further described herein below, the array 150 may be a phased array with appropriately arranged or structured unit cells 200 and DRAs 300, 400, and appropriately arranged signal feed structures (further discussed herein below) that provide for dual frequency operation and/or dual electromagnetic polarization, such as right-hand-circular-polarization, RHCP, and left-hand-circular-polarization, LHCP, for example. As used herein, the phrase "multi-resonator array" is used as a short-hand phrase to describe the array 150 of multi-resonator unit cells 200 with paired antennas 300, 400 that operate at different frequencies.

While FIG. 1 depicts a two-DRA (300, 400) unit cell 200, it is contemplated that a unit cell 200 having three or more DRAs is constructable according to the principles of an embodiment disclosed herein to provide even greater multi-frequency operation above a dual-frequency apparatus. As such, the appended claims should not be limited in any manner that would be contrary to the broadest interpretation of the claim language itself.

Figure 2A:
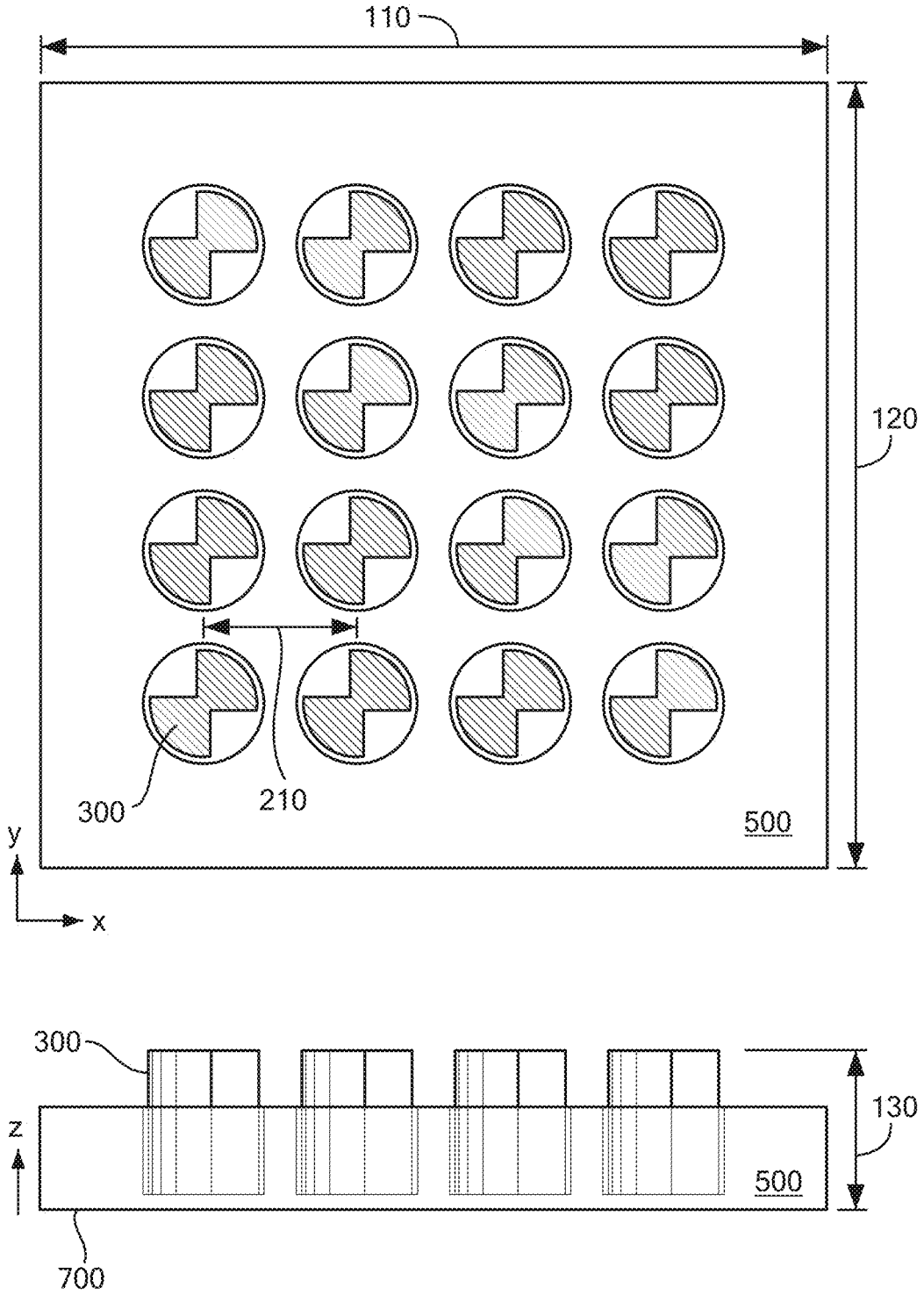
FIGS. 2A and 2B depict respective top down plan views of an example EM apparatus respectively in the form of a partial multi-resonator array having a plurality of a first DRA, and a multi-resonator array having the plurality of the first DRA and corresponding ones of a second DRA, for right-hand-circular and left-hand-circular polarization, arranged within an EM reflector, in accordance with an embodiment.
Figure 2B:
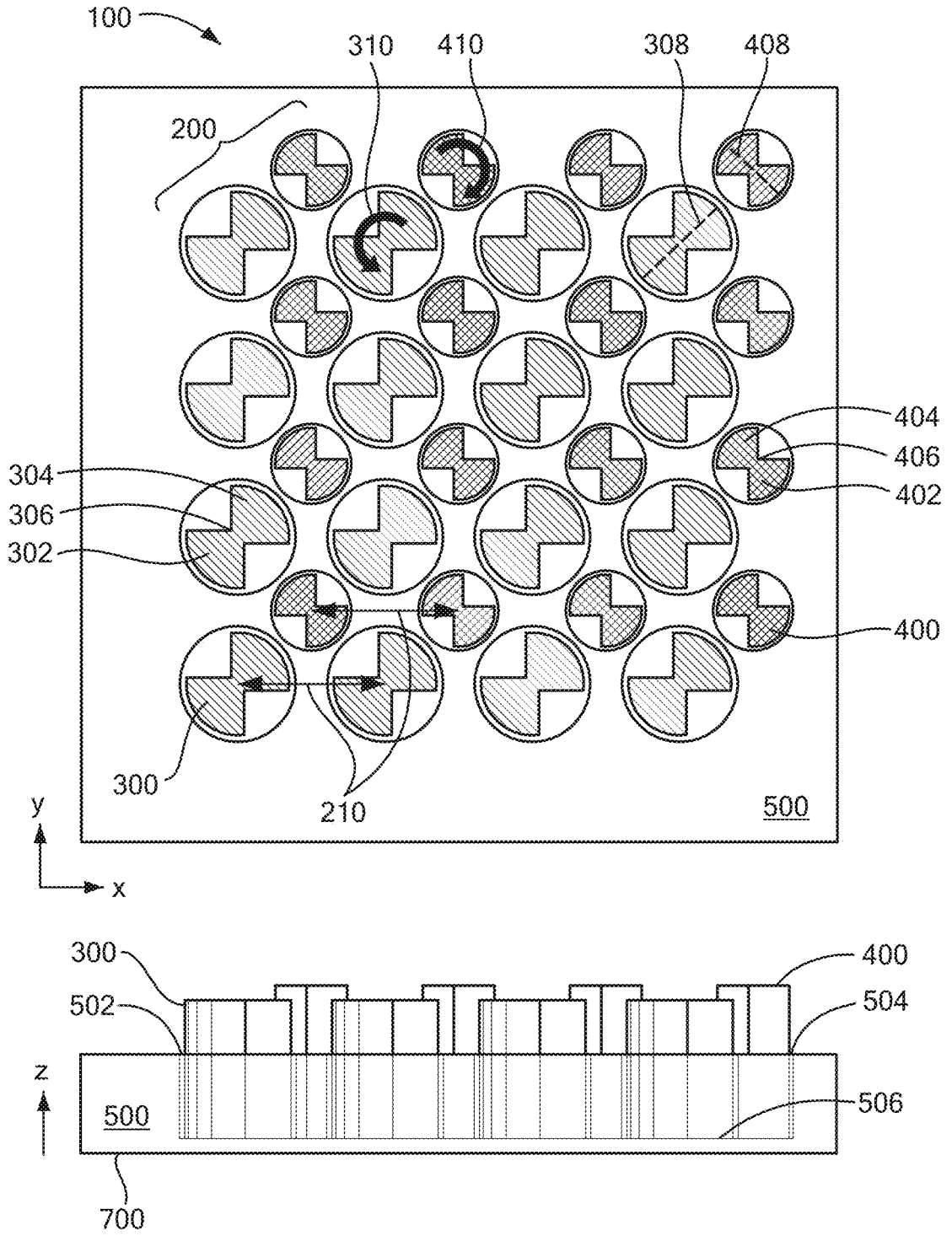

FIGS. 2A and 2B depict respective top down plan views of an example EM apparatus 100, similar to that of FIG. 1, in the form of a partial multi-resonator array having a plurality of a first DRA 300 absent corresponding ones of the second DRA 400 (FIG. 2A), and a multi-resonator array having the plurality of the first DRA 300 and corresponding ones of a second DRA 400 (FIG. 2B) arranged for LHCP and RHCP, with each unit cell 200 arranged within an EM reflector 500. In an embodiment, the EM reflector 500 is disposed on and in electrical communication with a substrate 700, such as a dielectric medium having upper and lower metal layers (copper for example), where a signal feed (discussed herein below) is disposed in or on the substrate 700. As used herein, the phrase "partial multi-resonator array" refers to the multi-resonator array 150 that is absent corresponding ones of the second DRA 400. As illustrated, each first DRA 300 and each second DRA 400 has a corresponding first enlarged portion 302, 402, and an opposing second enlarged portion 304, 404, with a corresponding necked down region 306, 406 disposed therebetween, which in view of the illustration in FIG. 2B is herein referred to as a bowtie configuration. In an embodiment, the bowtie configuration is an extrusion construct along the z-axis (depicted in the side elevation views in the lower images of FIGS. 2A and 2B, and out of the plane of illustration with respect to the top down plan views depicted in the upper images of FIGS. 2A and 2B). In an embodiment and as illustrated, the first DRA 300 has a first orientation 308 with respect to the locations of the centers of mass of the respective first and second enlarged portions 302, 304, and the second DRA 400 has a second orientation 408 with respect to the locations of the centers of mass of the respective first and second enlarged portions 402, 404, where the second orientation 408 is orthogonal to the first orientation 308, which serves to establish a LHCP 310 far field radiation and a RHCP 410 far field radiation, for a defined signal feed (discussed further herein below). In an embodiment, the EM reflector 500 has discrete cavities or pockets 502, 504 in which respective ones of the first and second DRA 300, 400 of a given unit cell 200 are disposed, which themselves are disposed on a common electrically conductive floor 506 of the respective cavity 502, 504. As depicted in FIG. 2A, an embodiment of the EM apparatus 100 has an overall plan view dimension 110 parallel to the x-axis, and an overall plan view dimension 120 parallel to the y-axis. In an embodiment, dimension 110 is equal to about 55 mm (millimeters), and dimension 120 is equal to about 55 mm. In an embodiment, the EM apparatus 100 has an overall side view elevation height 130 from the bottom of the EM reflector 500 to the top of the first DRA 300. In an embodiment height 130 is equal to about 11 mm. In an embodiment, the second DRA 400 has an overall height that is greater than the overall height of the first DRA 300. In an embodiment, adjacent pairs of unit cells 200 have a center to center, CTC, spacing 210. In an embodiment, the CTC spacing 210 in the x-direction is equal to about $\lambda/2$, where $\lambda$ is the wavelength at a desired upper operational frequency, which in an embodiment is 14 GHz, where $\lambda/2$ is equal to about 10.7 mm. In an embodiment the CTC spacing of adjacent pairs of unit cells 200 in the y-direction is equal to the CTC spacing 210 in the x-direction. In an embodiment, the relative dielectric constant, Dk, of the first DRA 300 and of the second DRA 400, is equal to about 14, or alternatively equal to or greater than 10 and equal to or less than 20. In an embodiment, a distinction between the second DRA 400 and the first DRA 300 is provided by their physical dimensions, where the second DRA 400 is structurally smaller than the first DRA 300, as observed in a top down plan view, while having the same 3D shape as the first DRA 300. In an embodiment, the first DRA 300 is sized for resonance at an operational frequency of 11 GHz, and the second DRA 400 is sized for resonance at an operational frequency of 14 GHz. In an embodiment, the lower operational frequency range is equal to or greater than 10 GHz and equal to or less than 13 GHz, and the upper operational frequency range is greater than 13 GHz and equal to or less than 15 GHz, or the lower operational frequency range is equal to or greater than 10 GHz and less than 13 GHz, and the upper operational frequency range is equal to or greater than 13 GHz and equal to or less than 15 GHz.

While the above description identifies a distinction between the first and second DRAs 300, 400 for achieving dual frequency band operation, namely different physical sizes with same 3D shape, it will be appreciated from a complete reading of this disclosure that other distinctions for achieving the same dual frequency band operation are possible and contemplated. For example: the second DRA 400 may have a 3D shape that is distinctly different from a 3D shape of the first DRA 300, whether they are the same or different physical size; or, the second DRA 400 may have a relative dielectric constant, Dk, that is distinctly different from a Dk of the first DRA 300.

Figure 3A:
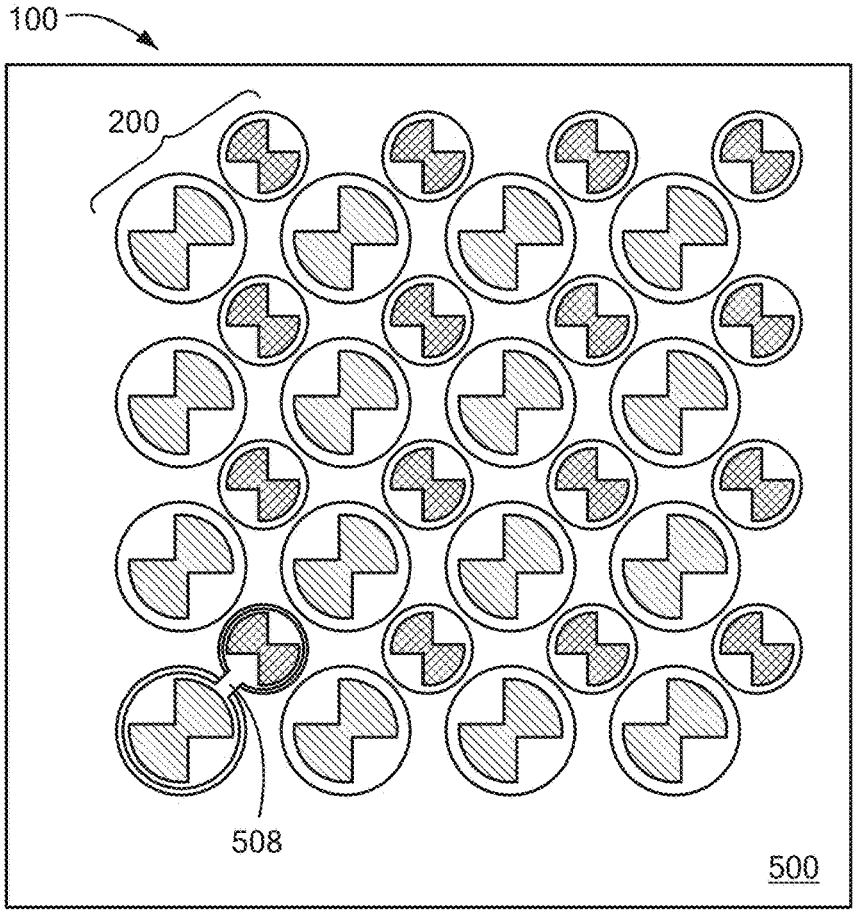
FIGS. 3A and 3B depict respective top down plan views of the example array of FIG. 2B with a channel cut in the EM reflector between paired antennas, in accordance with an embodiment.
Figure 3B:
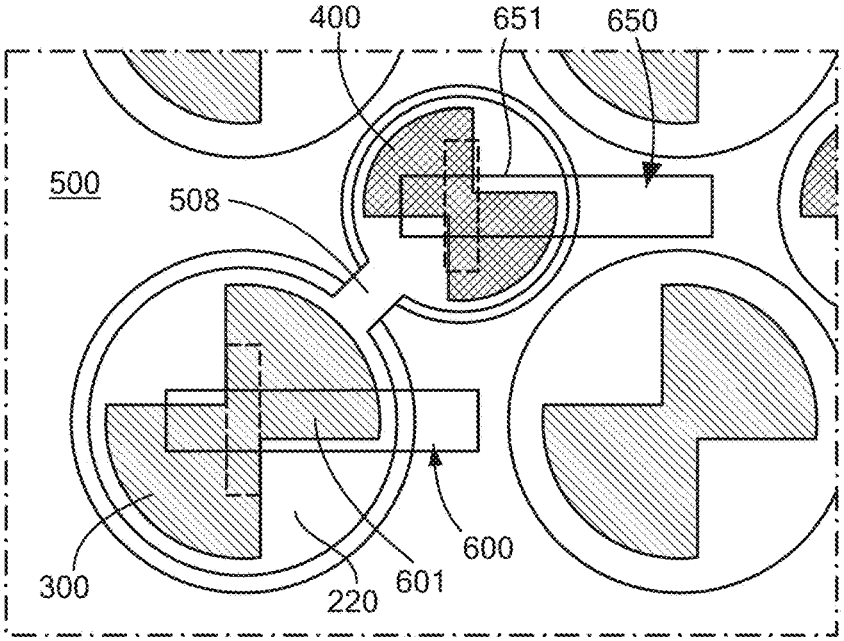

FIGS. 3A and 3B depict respective top down plan views of the example array of FIG. 2B, but with a channel or bridge region 508 cut in the EM reflector 500 between paired first and second DRAs 300, 400. FIG. 3B is an enlarged portion of the array of FIG. 3A to better illustrate the channel 508. In an embodiment, the region 220 of the unit cell 200 between the first and second DRAs 300, 400 and the EM reflector 500 is filled with a dielectric medium that cohesively joins the first DRA 300 with the second DRA 400. In an embodiment, the dielectric medium of the region 220 has a Dk of greater than 1 and equal to or less than 5, and in an embodiment has a Dk equal to about 3. In an embodiment, the region 220 filled with a common dielectric medium forms a relatively thin connecting structure at the channel 508 that is relatively thin as compared to an overall dimension of the first and second DRAs 300, 400. As depicted in FIG. 3B, a first signal feed 600 is disposed in electromagnetic signal communication with the first DRA 300, and a second signal feed 650 is disposed in electromagnetic signal communication with the second DRA 400. In an embodiment, the first and second signal feeds 600, 650 are slotted aperture signal feeds with corresponding orthogonally oriented signal lines 601, 651 that are oriented in the same direction as each other. Here, with the signal lines 601, 651 oriented in the same direction, it is the orientation of the first and second DRAs 300, 400 that produce the dual polarization signal from the unit cell 200. However, it will be appreciated that dual polarization may be achieved by orienting the first and second signal feeds 600, 650 orthogonal to each other, and orienting the first and second DRAs 300, 400 parallel with each other, which will become evident with a further reading of the description herein below. By providing a unit cell 200 that includes the first and second DRAs 300, 400 joined by a common dielectric medium at region 220, a single extrusion may be employed for a pick-and-place assembly process to provide a unit cell 200 of both resonators 300, 400 together for both LHCP and RHCP.

Figure 4A:
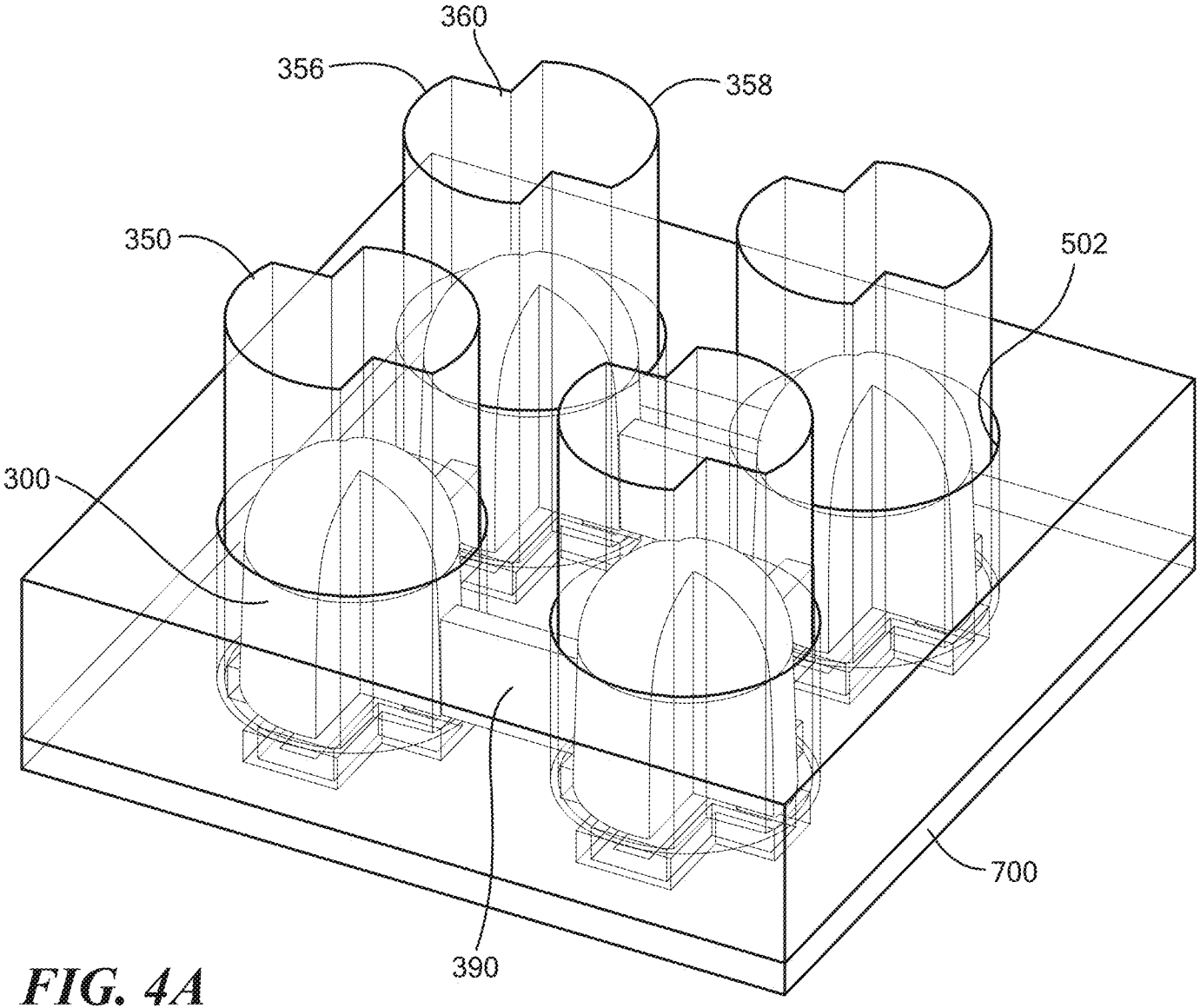
FIGS. 4A and 4B respectively depict, respectively, a rotated isometric view and a top down plan view, of an example partial multi-resonator array with each unit cell having a DRA and a corresponding lens, in accordance with an embodiment.
Figure 4B:
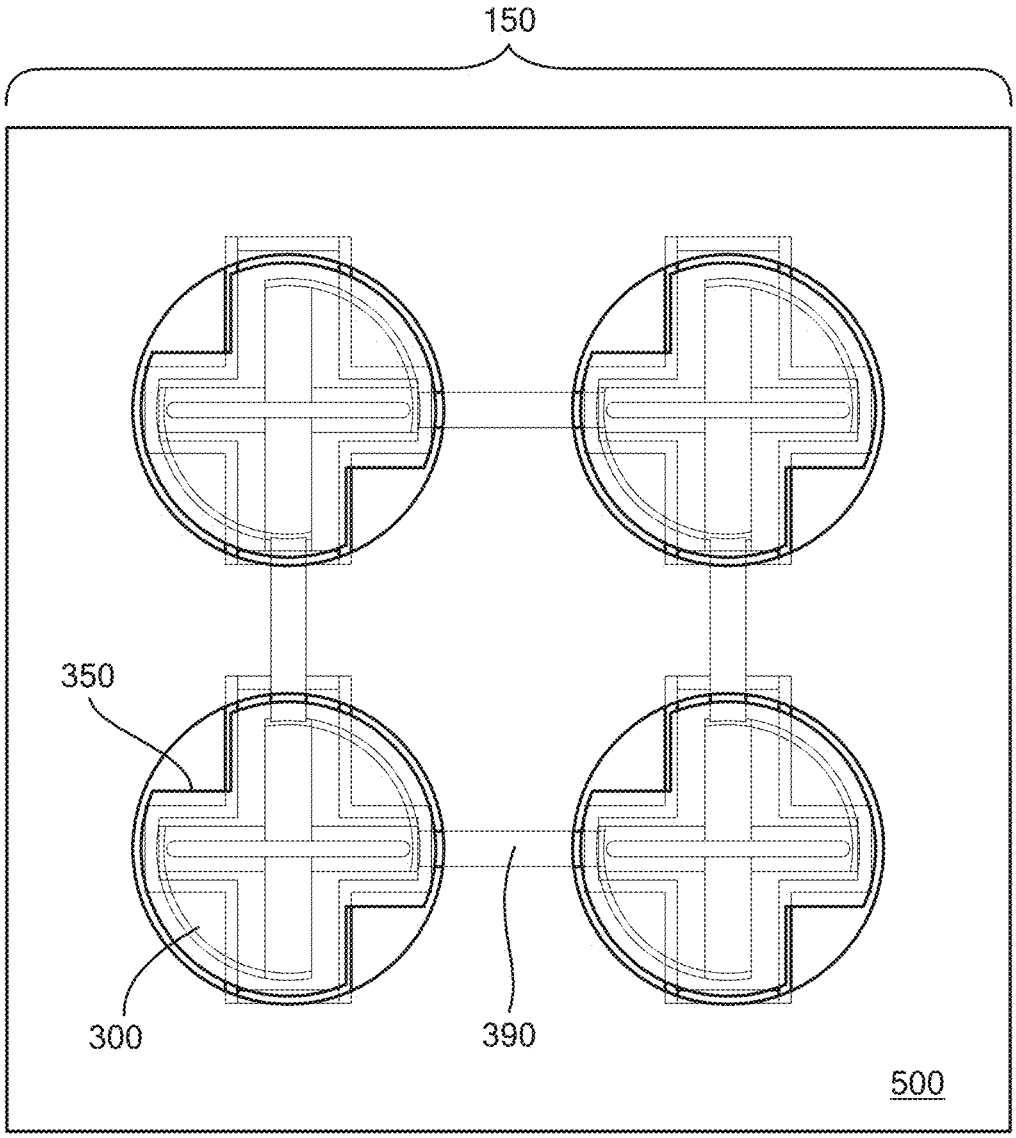
Figure 5:
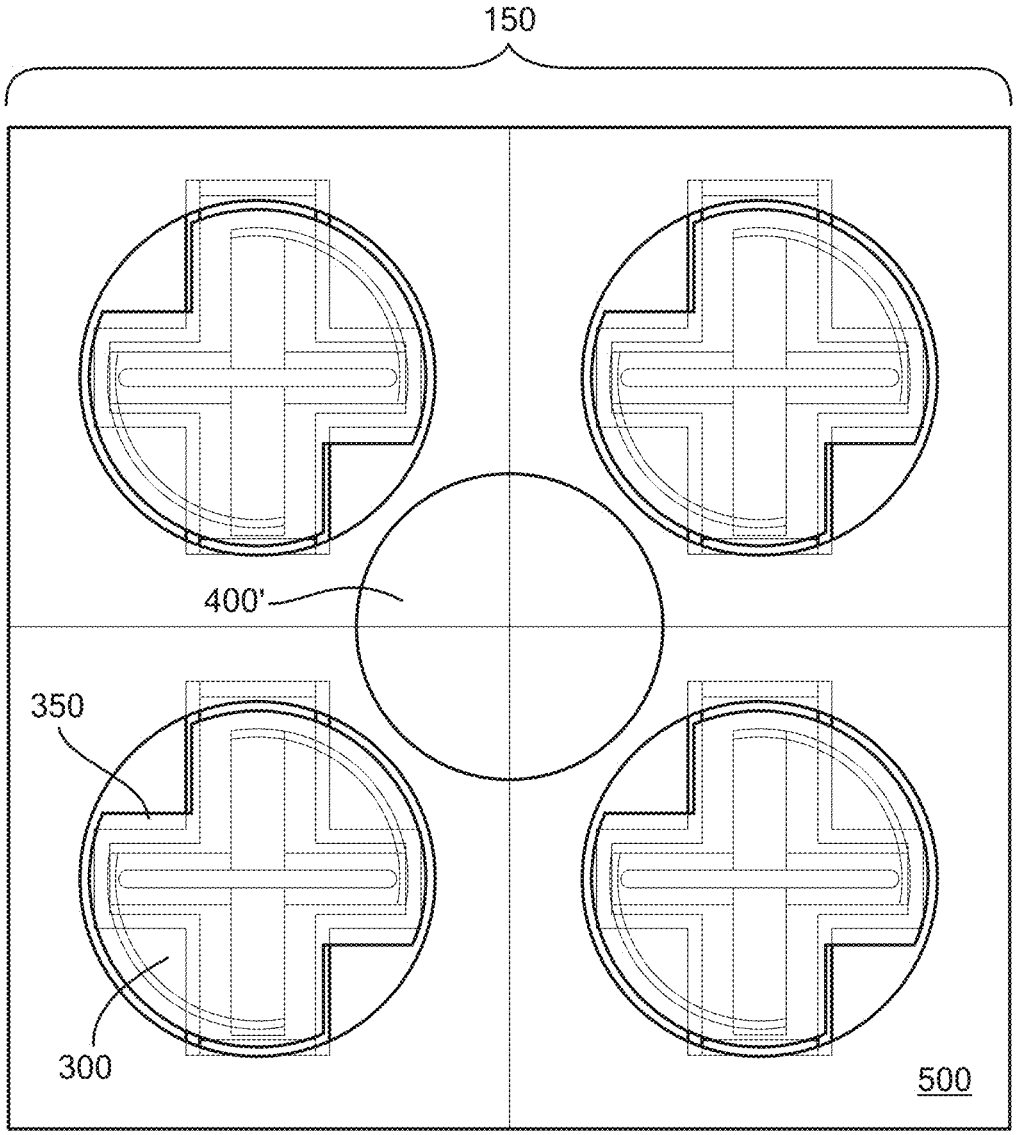
FIG. 5 depicts a top down plan view of the partial multi-resonator array of FIG. 4B, but with a location identifier for a corresponding one of a second DRA, in accordance with an embodiment.

FIGS. 4A and 4B respectively depict, a rotated isometric view and a top down plan view, of an example partial multi-resonator array 150 with each unit cell having a first DRA 300, a corresponding lens 350 (depicted in transparent view) disposed on and over the associated first DRA 300, and a relatively thin connecting structure 390 than joins adjacent ones of the first DRA 300. In an embodiment, the relatively thin connecting structure 390 has an overall width dimension that is less than an overall width dimension of the first DRA 300 as observed in a top down plan view, and the relatively thin connecting structure 390 has an overall height dimension that is less than an overall height dimension of the first DRA 300 as observed in a side elevation view. In an embodiment and as depicted, the first DRA 300 may have a dome shaped top, and the lens 350 may have a flat shaped top. However, it will be appreciated that the first DRA 300 and the corresponding lens 350 may have the same or different shaped tops without detracting from a scope of the invention disclosed herein, depending on the desired performance characteristics. While not specifically illustrated, it will be appreciated that a second DRA may be appropriately located within each unit cell consistent with the foregoing description and as depicted in FIG. 5, which depicts a top down plan view of the partial multi-resonator array of FIG. 4B, but with a location identifier 400' for a corresponding one of a second DRA 400. Each second DRA 400' may similarly have a corresponding lens (see FIGS. 7A and 7B for example) disposed on and over the associated second DRA 400'. Each DRA 300 of FIGS. 4A, 4B and 5, has a plan view profile similar to that of FIG. 2B, which has a first enlarged portion 302 and an opposing second enlarged portion 304 with a corresponding necked down region 306 disposed therebetween (best seen with reference to FIG. 2B). Similarly, each lens 350 has a plan view profile that mimics the plan view profile of the corresponding DRA 300, and includes a first enlarged portion 356 and an opposing second enlarged portion 358 with a corresponding necked down region 360 disposed therebetween (FIG. 4A). In an embodiment, the plan view profile of the lens 350 is a bowtie configuration as discussed herein above. In an embodiment, the plan view profile bowtie configuration of the lens 350 is slightly larger than and completely encloses the bowtie configuration of the corresponding first DRA 300. Similar to other unit cells disclosed herein, the first DRA 300, and second DRA 400, along with any corresponding lens 350, is disposed within a corresponding pocket 502, 504 of the EM reflector 500. In an embodiment, the EM reflector 500 is disposed on and in electrical communication with a substrate 700, such as a dielectric medium having upper and lower metal layers, where a signal feed as disclosed herein is disposed in or on the substrate 700. While reference is made herein to a lens, it will be appreciated that such lens may alternatively be referred to as an EM beam shaper.

Figure 6A:
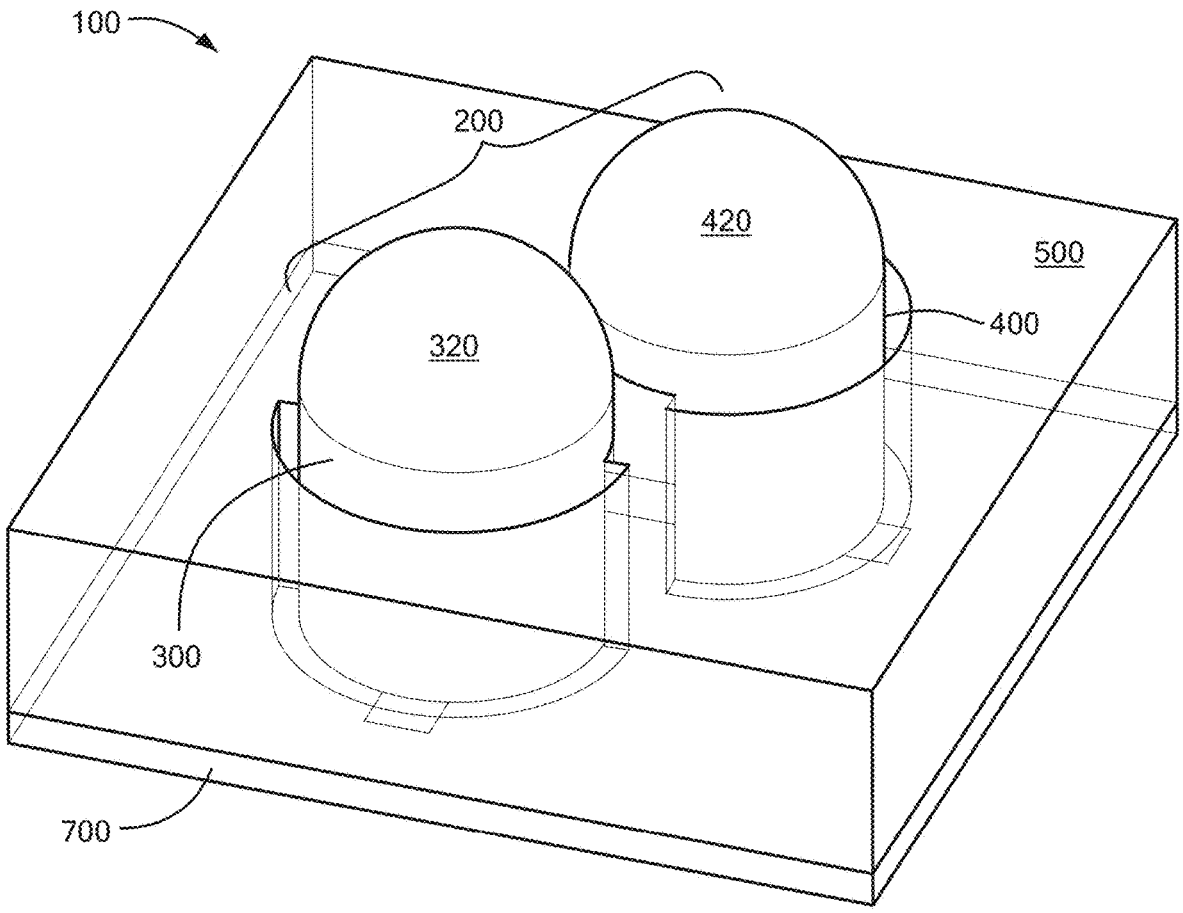
FIGS. 6A, 6B and 6C, respectively depict, a rotated isometric view, a side elevation view, and a top down planer cross section view through the EM reflector, of an example partial multi-resonator array with each unit cell having a "half" DRA, in accordance with an embodiment.
Figure 6B:
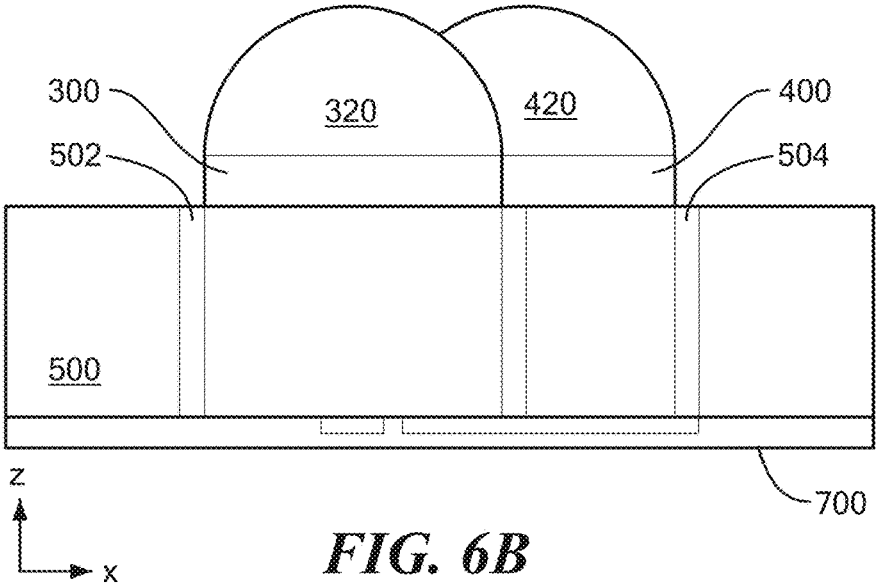
Figure 6C:
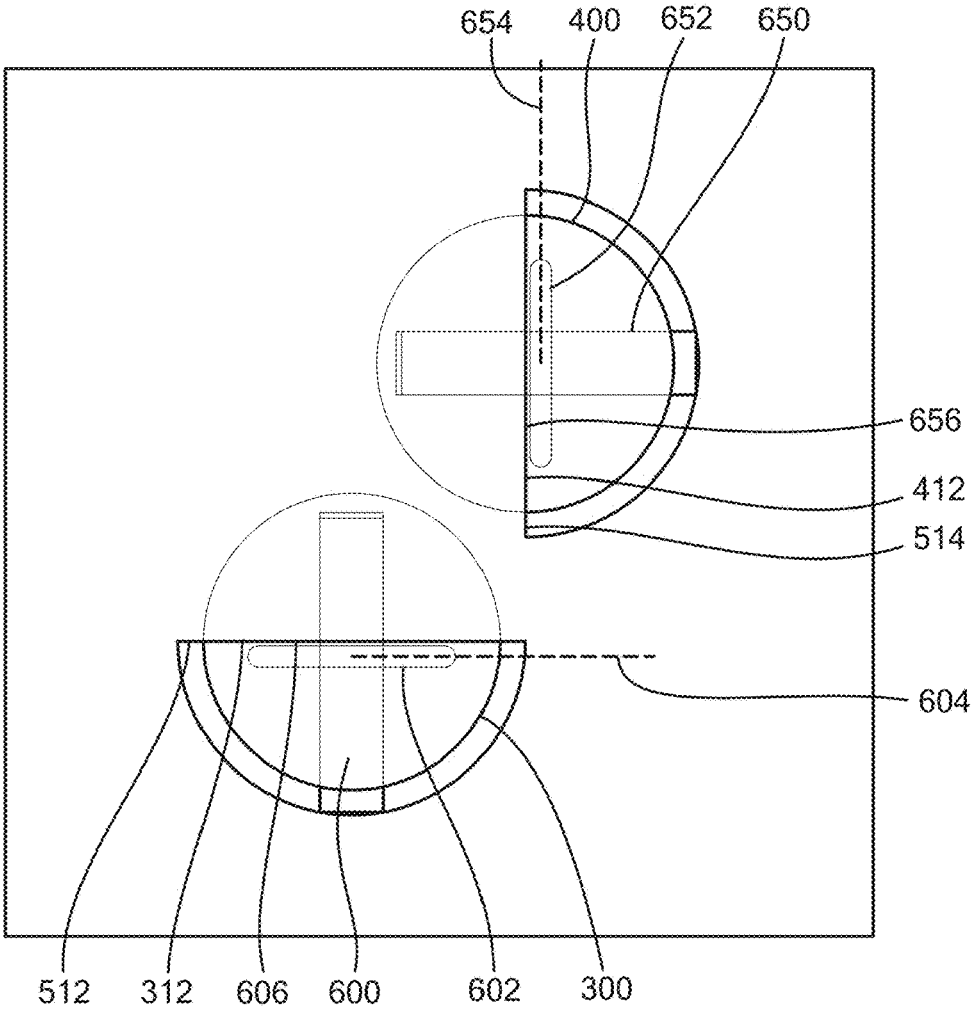

FIGS. 6A, 6B and 6C, respectively depict, a rotated isometric view, a side elevation view, and a top down planer cross section view through the EM reflector 500, of an example partial multi-resonator array with each unit cell having a "half" DRA. As used herein, the phrase "half DRA" is representatively rather than literally descriptive of a DRA, a first DRA 300 and/or a second DRA 400, that is almost but slightly larger than a half segment of an above described first DRA 300 or second DRA 400, which will now be described in more specific terms. While only one of the first and the second DRA 300, 400 is depicted in FIGS. 6A-6C, it will be appreciated that this is for illustration purposes only and that an embodiment having a "half" DRA construct for multiples of both the first DRA 300 and the second DRA 400 arranged in an array is inherently if not explicitly disclosed herein.

With respect to FIGS. 6A-6C collectively, the substrate 700 includes first and second EM signal feeds 600, 650, where each EM signal feed 600, 650 is disposed in a one-to-one correspondence with a corresponding one of the first and second DRAs 300, 400 of the unit cell 200. In an embodiment, each EM signal feed 600, 650 has a corresponding slotted aperture 602, 652, where the slotted aperture 602 of the first DRA 300 has a longitudinal orientation in a first direction 604, and the slotted aperture 652 of the second DRA 400 has a longitudinal orientation in a second direction 654. In an embodiment and as illustrated, the second direction 654 of the second slotted aperture 652 is orthogonal to the first direction 604 of the first slotted aperture 602. The first DRA 300 has a first planer surface 312 disposed parallel with the first direction 604 and disposed in electrical contact with a first electrically conductive planer surface 512 of the corresponding recess 502 of the EM reflector 500. The second DRA 400 has a second planer surface 412 disposed parallel with the second direction 654 and disposed in electrical contact with a second electrically conductive planer surface 514 of the corresponding recess 504 of the EM reflector 500. In an embodiment, the first DRA 300 completely covers the first slotted aperture 602, and the second DRA 400 completely covers the second slotted aperture 652. In an embodiment, the first planer surface 312 of the first DRA 300 is disposed at an edge 606 of the first slotted aperture 602, and the second planer surface 412 of the second DRA 400 is disposed at an edge 656 of the second slotted aperture 652. By virtue of the first and second DRAs 300, 400, completely covering the corresponding slotted apertures 602, 652, a better understanding of the term "half DRA" can be appreciated.

As can be seen from the rotated isometric view of FIG. 6A and the planer cross section view of FIG. 6C, each of the first DRA 300 and the second DRA 400 has a corresponding domed top 320, 420, which is part of the associated DRA 300, 400, but also contributes to EM beam shaping. In an embodiment, the domed tops 320, 420 may overhang an edge of the corresponding recess 502, 504, which serves to further enhance the EM radiation performance of the EM apparatus 100 (see FIGS. 10A and 10B, for example).

By reducing the size of the DRAs 300, 400 to a "half" DRA construct as disclosed herein, it has been found through analytical modeling that the same resonant frequency may be achieved as a "full" DRA construct but in a more compact array that reduces the overall space requirement of the array.

Figure 7A:
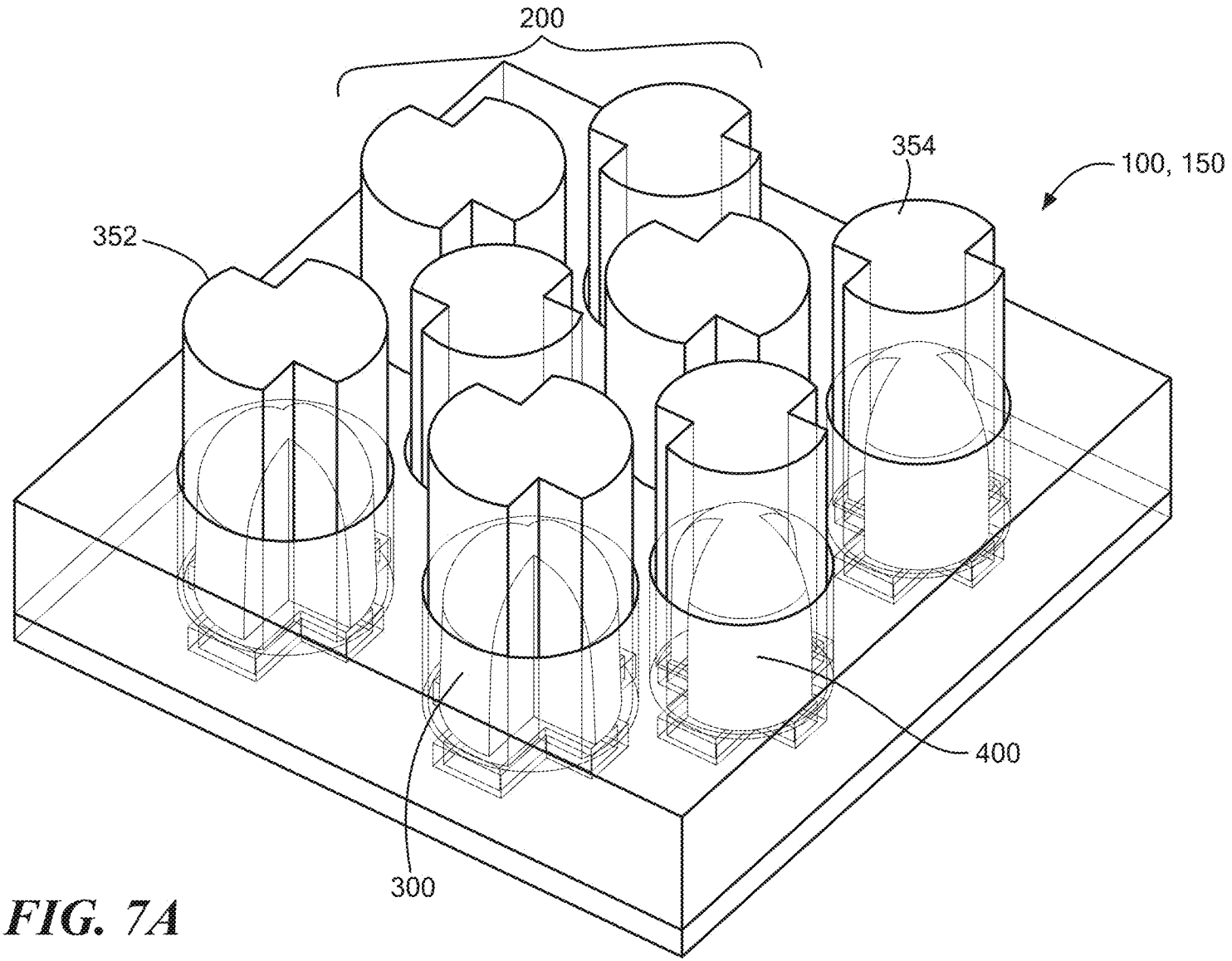
FIGS. 7A and 7B, respectively depict, a rotated isometric view, and a top down plan view, of an example multi-resonator array with each unit cell having a first DRA and a second DRA with corresponding lenses, in accordance with an embodiment.
Figure 7B:
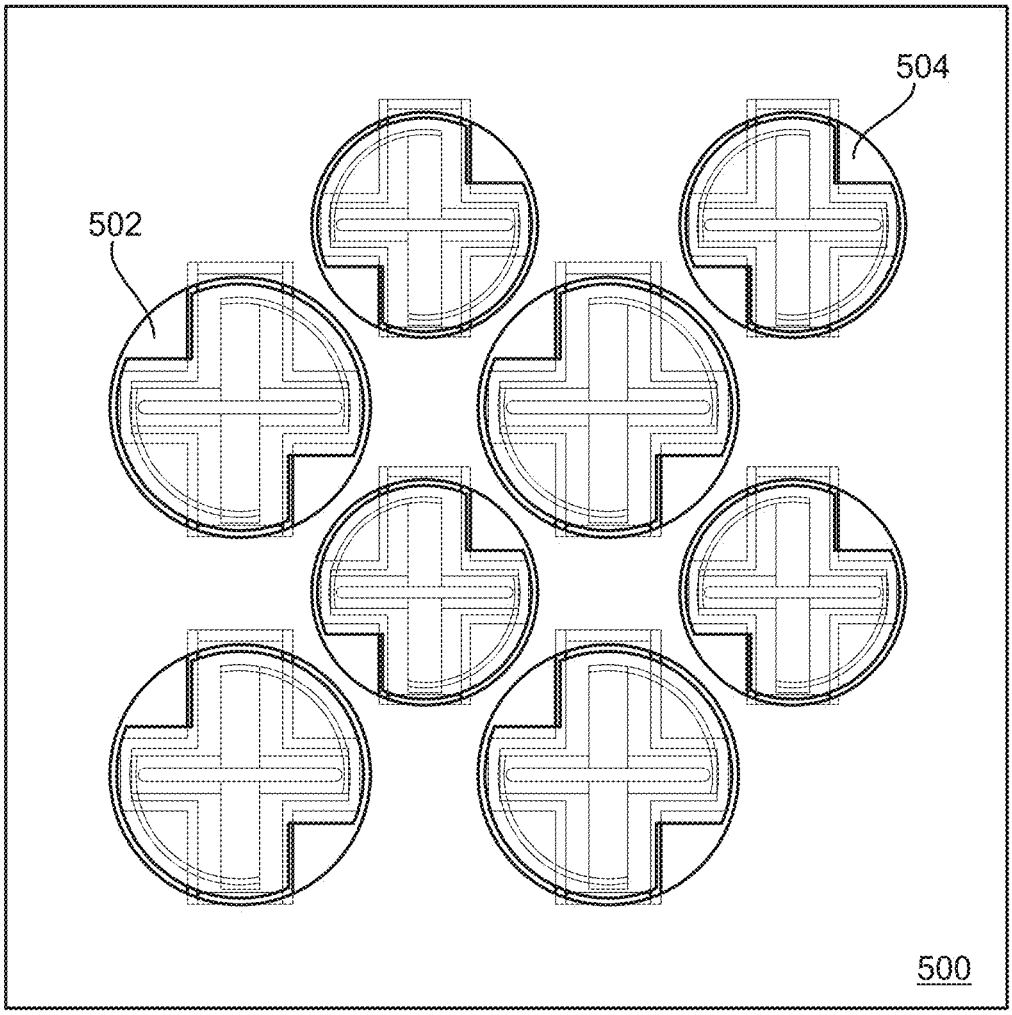

FIGS. 7A and 7B, respectively depict, a rotated isometric view, and a top down plan view, of an example EM apparatus 100 in the form of a multi-resonator array 150 with each unit cell 200 having a first and a second DRA 300, 400 with corresponding first and second lenses 352, 354, similar to the embodiment depicted in FIG. 4A, but with the second DRA 400 and second lens 354 now depicted in combination with the first DRA 300 and first lens 352 of a given unit cell 200 and in combination with an EM reflector 500.

Figure 8B:
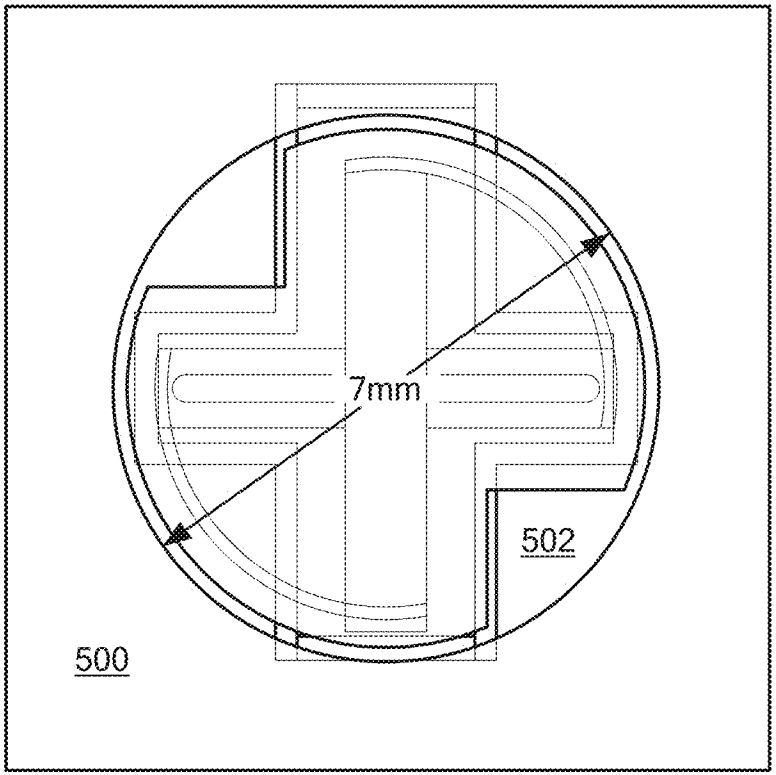
FIGS. 8A and 8B, respectively depict, a rotated isometric view, and a top down plan view, of the first DRA with corresponding lens of FIGS. 7A and 7B, in accordance with an embodiment.
Figure 8A:
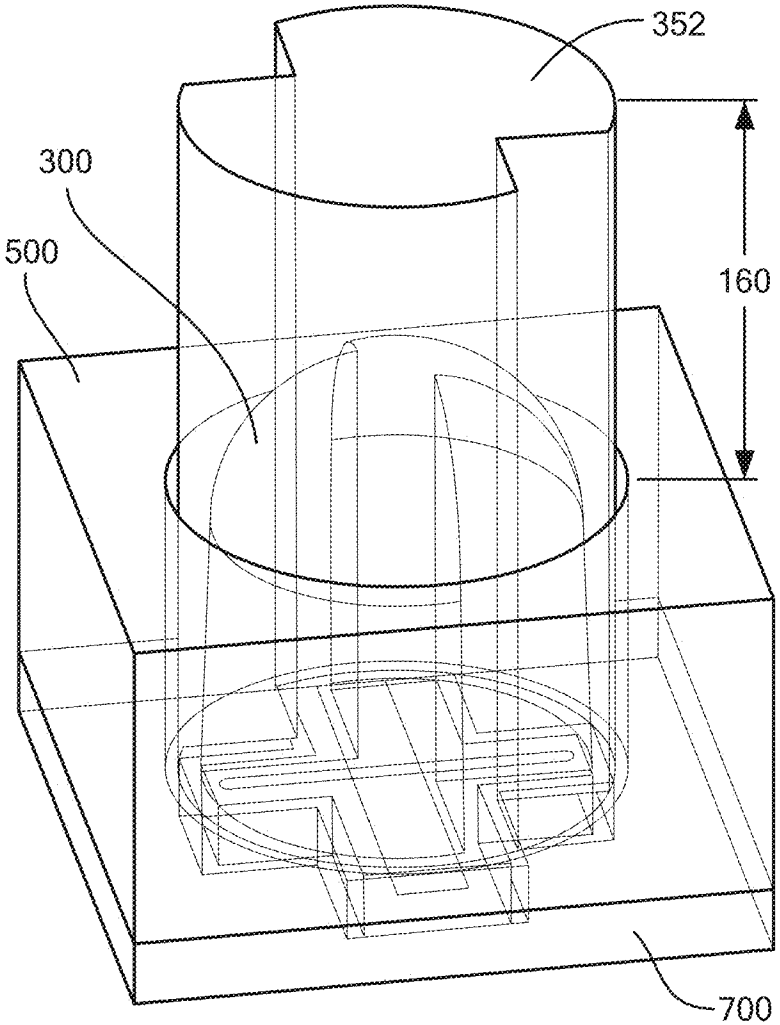

FIGS. 8A and 8B, respectively depict, a rotated isometric view, and a top down plan view, of the first DRA 300 with the corresponding first lens 352 of FIGS. 7A and 7B, disposed in a pocket 502 of an EM reflector 500.

Figure 9:
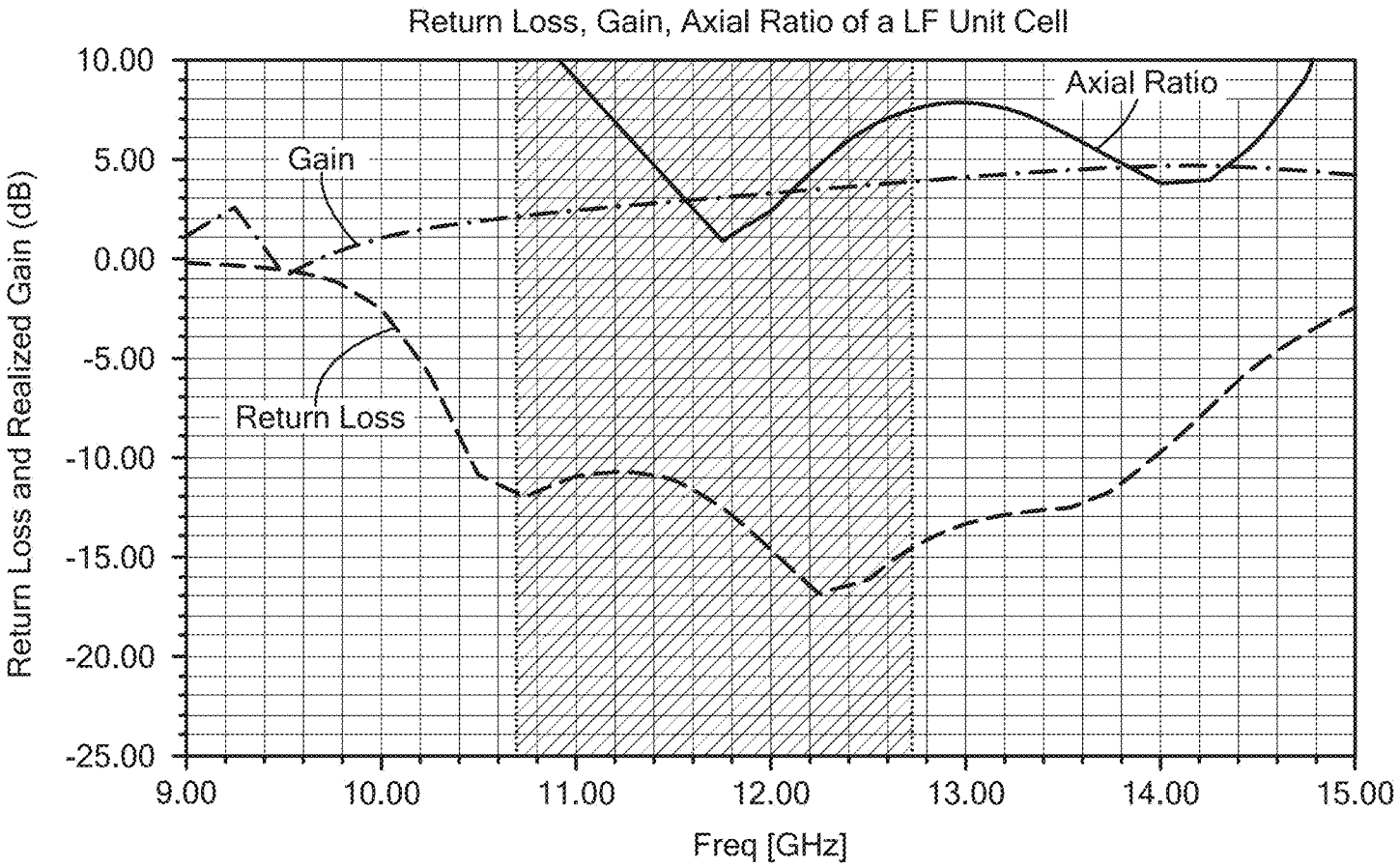
FIG. 9 depicts analytical performance characteristics of the first DRA with corresponding lens of FIGS. 8A and 8B, in accordance with an embodiment.

FIG. 9 depicts analytical performance characteristics of the first DRA 300 with the corresponding first lens 352 of FIGS. 8A and 8B. Similar to the embodiment depicted in FIG. 4A, the first and second DRAs 300, 400 have a domed shaped top, and the first and second lens 352, 354 have a flat shaped top. Also similar to the embodiment depicted in FIG. 4A, the first and second lenses 352, 354 have bowtie configurations that enclose the bowtie configurations of the corresponding first and second DRAs 300, 400, and each unit cell 200 is disposed in corresponding pockets 502, 504 of the EM reflector 500. As best seen with reference to FIGS. 7A and 8A, an embodiment includes an arrangement where the first and second lenses 352, 354 are disposed on top of and completely enclose the corresponding first and second DRAs 300, 400, and the first and second lenses 352, 354 extend above and outboard of the EM reflector 500 by a defined distance 160 along the z-axis. With reference to FIGS. 7A-7B and 8A-8B, each resonator of the unit cell 200 is referred to as two-dielectric resonator, where the DRA's 300, 400 are formed of a first dielectric, and the lenses 352, 354 are formed of a second dielectric. In an embodiment, the first dielectric has a Dk value that is relatively higher than the Dk value of the second dielectric. In an embodiment, the Dk value of the first dielectric is equal to or greater than 10 and equal to or less than 20, and in an embodiment is equal to about 14. In an embodiment, the Dk value of the second dielectric is greater than 1 and equal to or less than 5, and in an embodiment is equal to about 3. In an embodiment, the first DRA 300 is sized to fit with clearance within a cavity 502 of the EM reflector 500 that has an example diameter of about 7 mm (see FIG. 8B for example). In an embodiment, the second DRA 400 is similarly sized as the first DRA 300. As depicted in FIG. 9, the two-dielectric resonator as disclosed herein has a gain, return loss, and axial ratio, as shown, which will be compared herein below to a single-dielectric resonator.

Figure 10B:
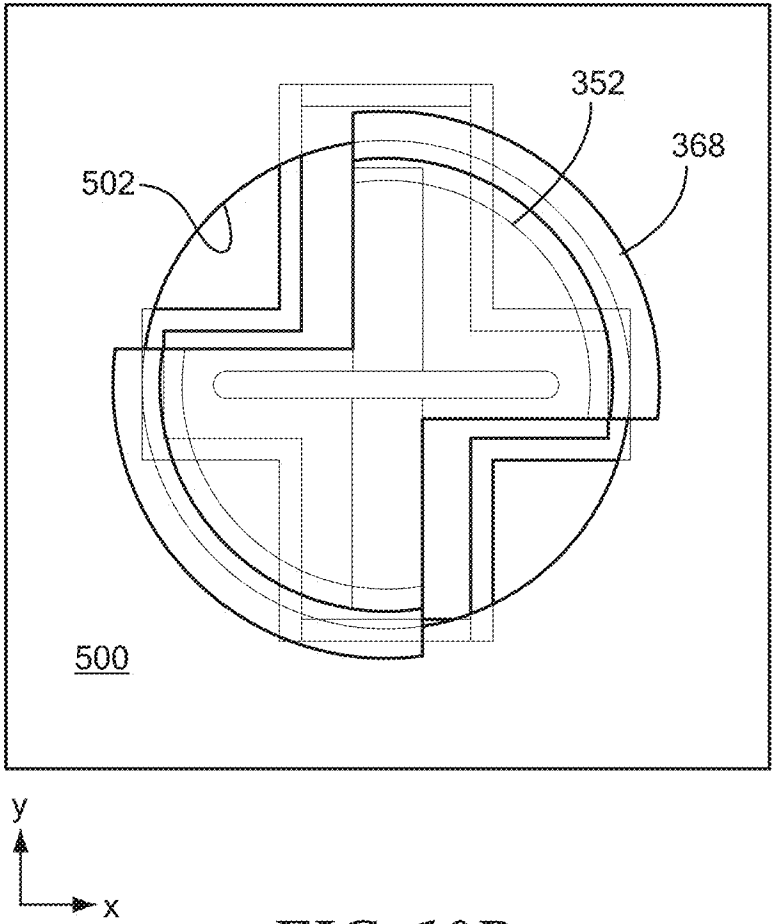
FIGS. 10A and 10B, respectively depict, a rotated isometric view, and a top down plan view, of an example first DRA with a corresponding lens formed from a single dielectric material, in accordance with an embodiment.
Figure 10A:
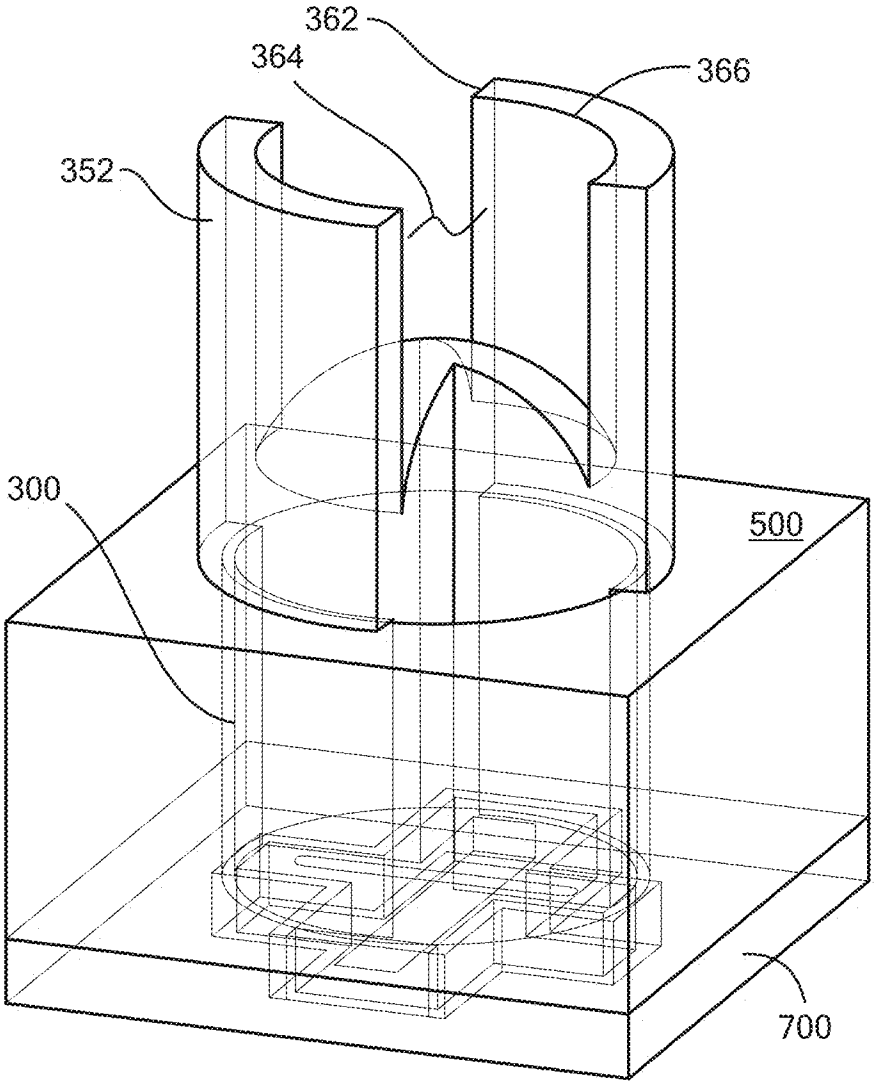
Figure 11:
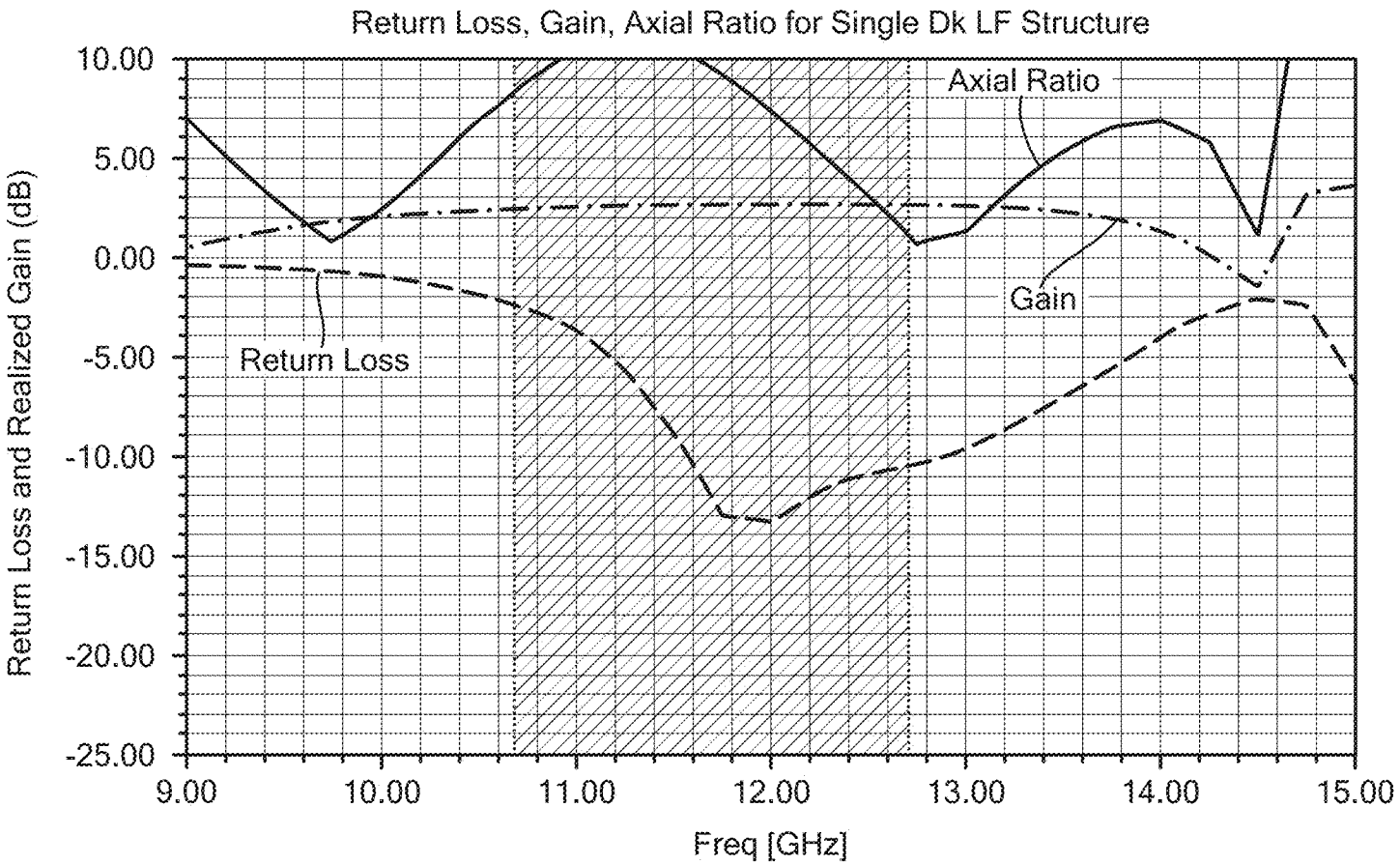
FIG. 11 depicts analytical performance characteristics of the first DRA with corresponding lens of FIGS. 10A and 10B, in accordance with an embodiment.

Reference is now made to FIGS. 10A and 10B, which respectively depict, a rotated isometric view, and a top down plan view, of an example first DRA 300 with a corresponding first lens 352 integrally formed from a single dielectric material, which is herein referred to as a single-dielectric resonator for use in a multi-resonator array, as disclosed herein. As depicted, the corresponding first lens 352 is integrally formed with the first DRA 300 to form a monolithic structure. In an embodiment, the first lens 352 has a complete or partially complete side wall 362 formed from dielectric material of the first DRA 300 that surrounds or partially surrounds an inner region 364 of the first lens 352, where the inner region 364 is formed of a dielectric medium having a relative dielectric constant, Dk, that is less than the Dk of the dielectric material of the first DRA 300. In an embodiment, the first lens 352 has an open top 366 and a hollow inner region 364 absent of the dielectric material of the first DRA 300. In an embodiment, the first lens 352 has an outer perimeter 368 proximate the EM reflector 500 that overhangs an edge of the cavity 502 of the EM reflector 500. As depicted in FIG. 11, which depicts analytical performance characteristics of the first DRA 300 with the corresponding first lens 352 of FIGS. 10A and 10B, the single-dielectric resonator as disclosed herein has a gain, return loss, and axial ratio, as shown, which will now be compared with similar plots for the two-dielectric resonator depicted in FIG. 9.

A comparison between FIGS. 9 and 11 highlights the following in the frequency range of 10.7 GHZ to 12.7 GHz at the minimum axial ratio (AR), where it is recognized that desirable circular polarization occurs at AR=0: the two-dielectric resonator (FIG. 9) has minimum AR of 1 at about 11.75 GHz, a gain of 3 dBi at AR=1, and a return loss of −12.5 dBi at AR=1; and, the single-dielectric resonator (FIG. 11) has a minimum AR of 1 at about 12.75 GHz, a gain of 3 dBi at AR=1, and a return loss of −10.5 dBi at AR=1. Such comparison suggests that the single-dielectric resonator is comparable in performance to the two-dielectric resonator, but at an upward shift in operating frequency. While FIG. 9 illustrates better performance as compared to FIG. 11, it is contemplated that enhanced performance may be achieved with additional tuning of the respective designs.

Figure 12A:
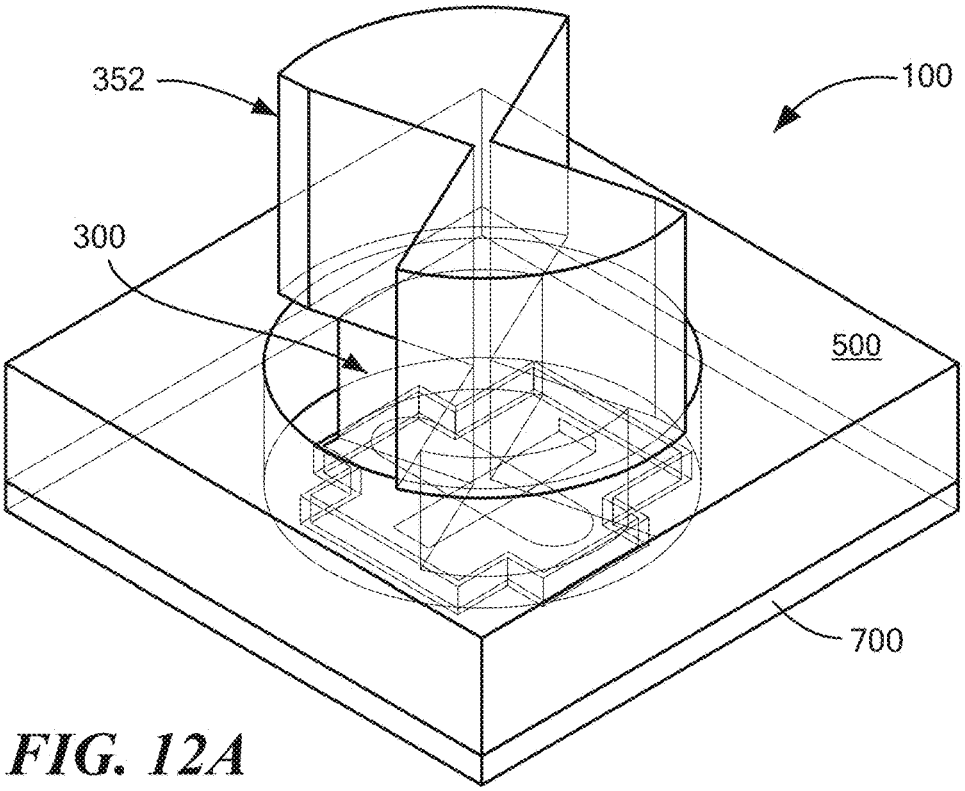
FIGS. 12A, 12B, and 12C, respectively depict, a rotated isometric view, a top down plan view, and a side elevation view, of a two-dielectric resonator with corresponding lens, in accordance with an embodiment.
Figure 12B:
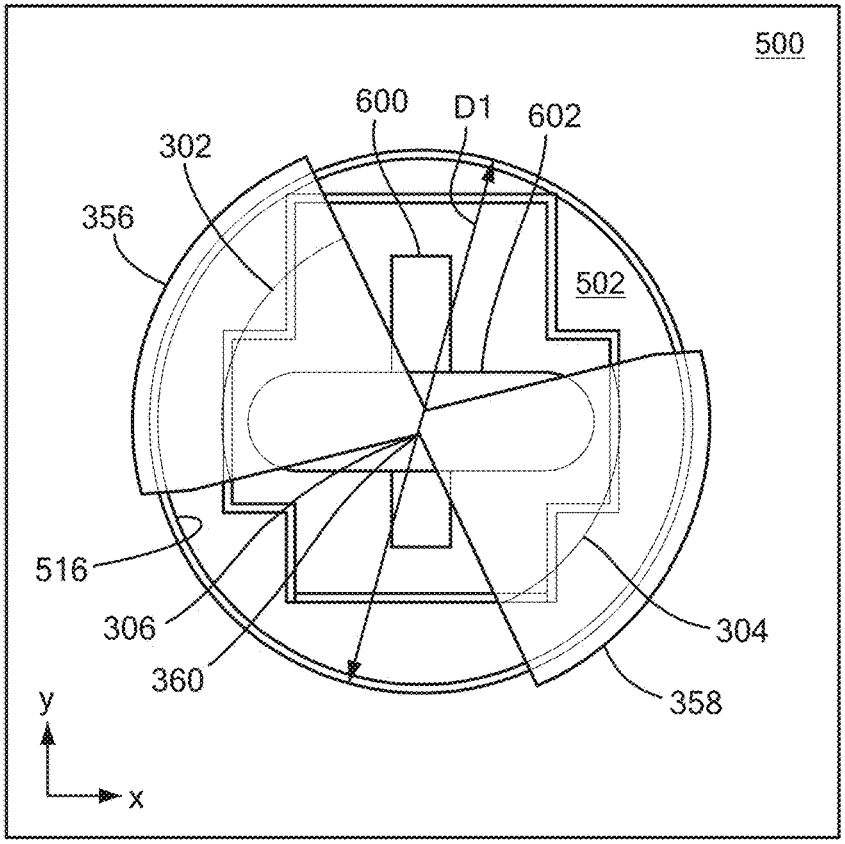
Figure 12C:
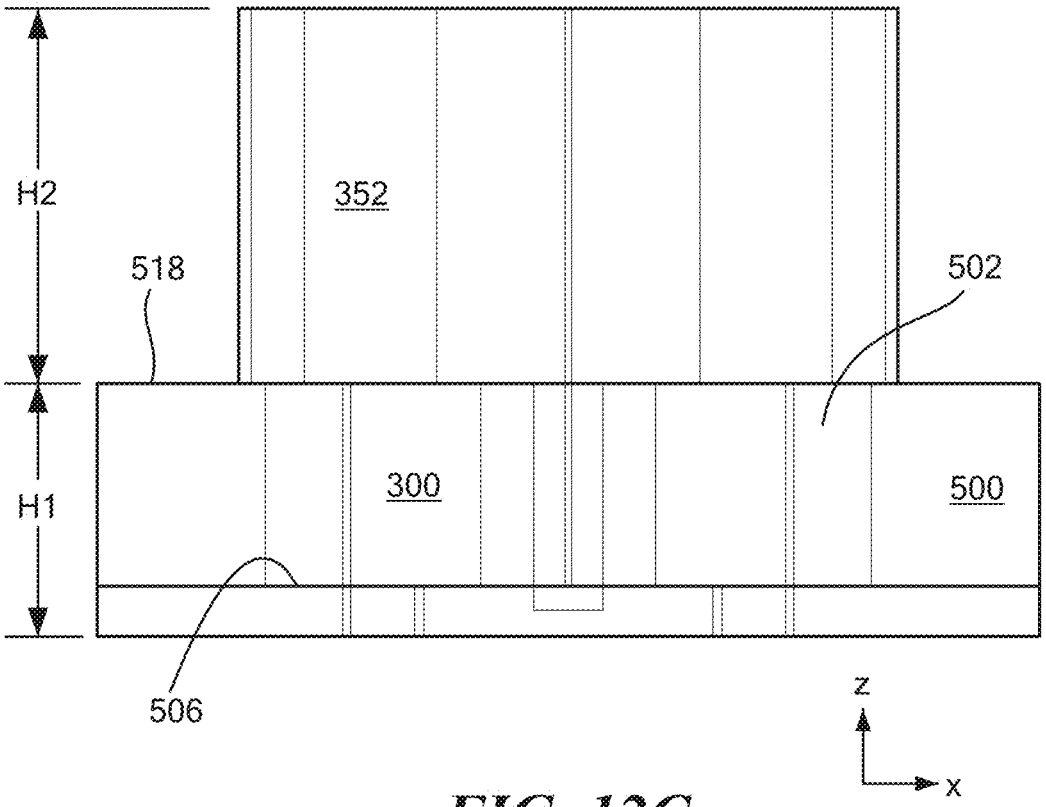

FIGS. 12A, 12B, and 12C, respectively depict, a rotated isometric view, a top down plan view, and a side elevation view, of a two-dielectric resonator with corresponding lens, similar to the embodiments of FIGS. 7A, 7B, 8A and 8B, but with points of distinction that will now be described. Similar to other EM apparatus 100 described herein, the EM apparatus 100 of FIGS. 12A-12C have a first DRA 300 and a first lens 352 disposed on the first DRA 300, where the first DRA is disposed in a pocket 502 of an EM reflector 500 and sits on an electrically conductive floor 506 of the pocket 502, and where the EM reflector 500 is disposed on a substrate 700 that includes a signal feed 600 with a slotted aperture 602. The illustrated first DRA 300, similar to other DRAs disclosed herein, also has first and second enlarged portions 302, 304 with a necked down region 306 disposed therebetween that forms a bowtie configuration. Similarly, the illustrated first lens 352 has first and second enlarged portions 356, 358 with a necked down region 360 disposed therebetween that forms a bowtie configuration. As depicted, the necked down region 360 of the first lens 352 has extrusion-like surfaces (in the z-direction) that are contiguous with extrusion-like surfaces of the necked down region 306 of the first DRA 300. As further depicted, outer perimeters of the first and second enlarged portions 356, 358 of the first lens 352 (as observed in a top down plan view) overhang an edge 516 of the pocket 502 of the EM reflector 500 in which the first DRA 300 is disposed, and are in electrical contact with an upper outer electrically conductive surface 518 of the EM reflector 500. Alternative to other EM apparatus 100 described herein, the first DRA 300 and first lens 352 depicted in FIGS. 12-12C do not fully cover the slotted aperture 602, which is herein referred to as an exposed slotted aperture 602. By overhanging the first lens 352 over an edge of the pocket 502 of the EM reflector 500, and by employing an exposed slotted aperture 602 configuration, it has been found through analytical modeling that desirable circular polarization is achieved. In an embodiment, the first DRA 300 has a Dk equal to about 17, and the first lens 352 has a Dk equal to about 5. However, it will be appreciated that the Dk values of the first DRA 300 and the first lens 352 may be any value consistent with the disclosure herein. In an embodiment, the first DRA 300 has a height H1 equal to the depth of the pocket 502, and in an embodiment is equal to about 3.34 mm. In an embodiment, the first lens 352 has a height H2 that is greater than H1, and in an embodiment is equal to about 6.22 mm. In an embodiment, the pocket 502 of the EM reflector 500 has a diameter D1 equal to about 10.1 mm.

Figure 13:
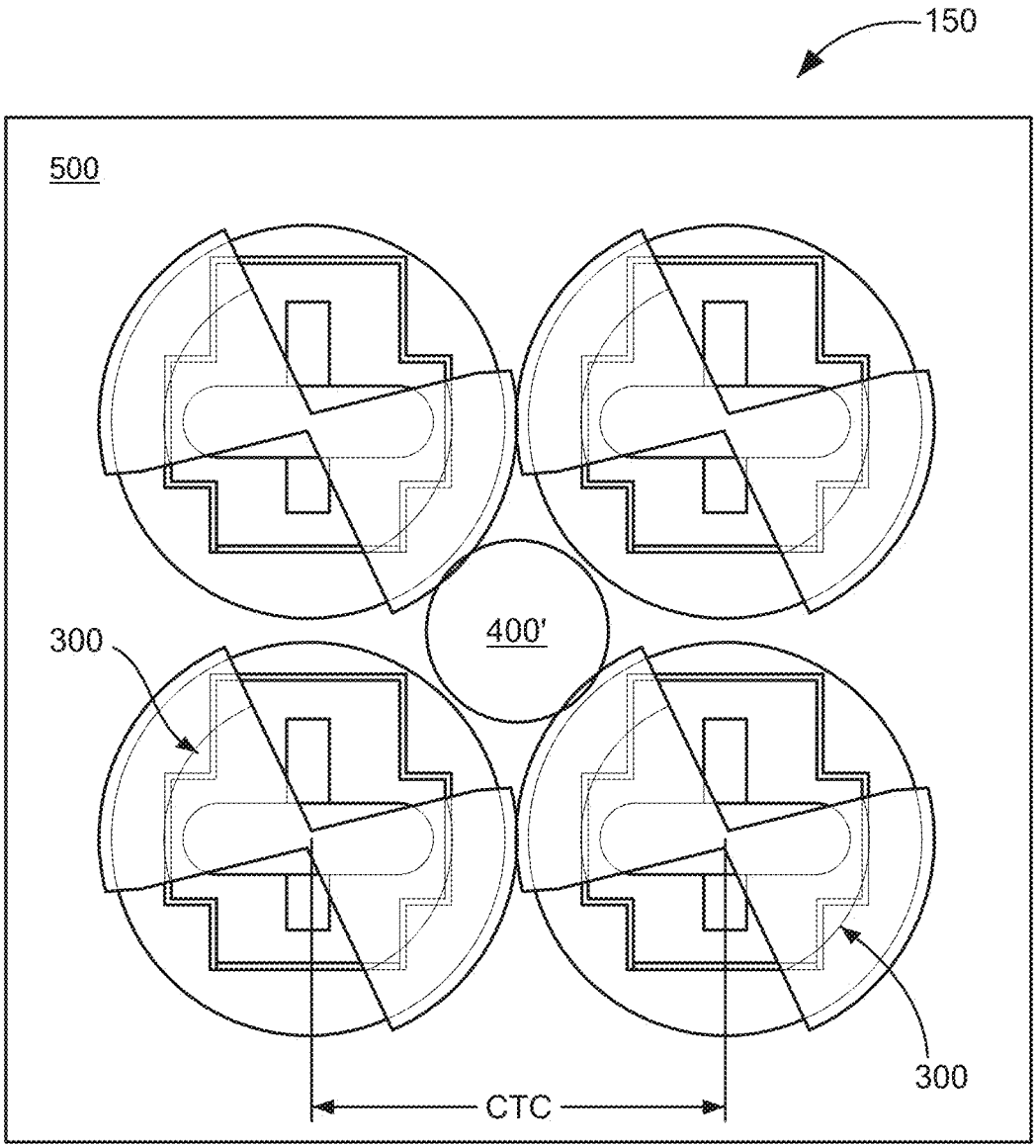
FIG. 13 depicts a top down plan view of a partial multi-resonator array having the embodiment of FIG. 12B, but with a location identifier for a corresponding one of a second DRA, in accordance with an embodiment.

FIG. 13 depicts a top down plan view of a partial multi-resonator 2×2 array 150 having the embodiment of FIG. 12B, but with a location identifier 400' for a corresponding one of a second DRA 400, which serves to form a dual band circular polarization antenna design. In an embodiment, the array 150 has a center to center, CTC, spacing between adjacent first DRAs 300 equal to about λ/2, which in an embodiment is equal to about 10.7 mm at 14 GHz operating frequency.

Figure 14:
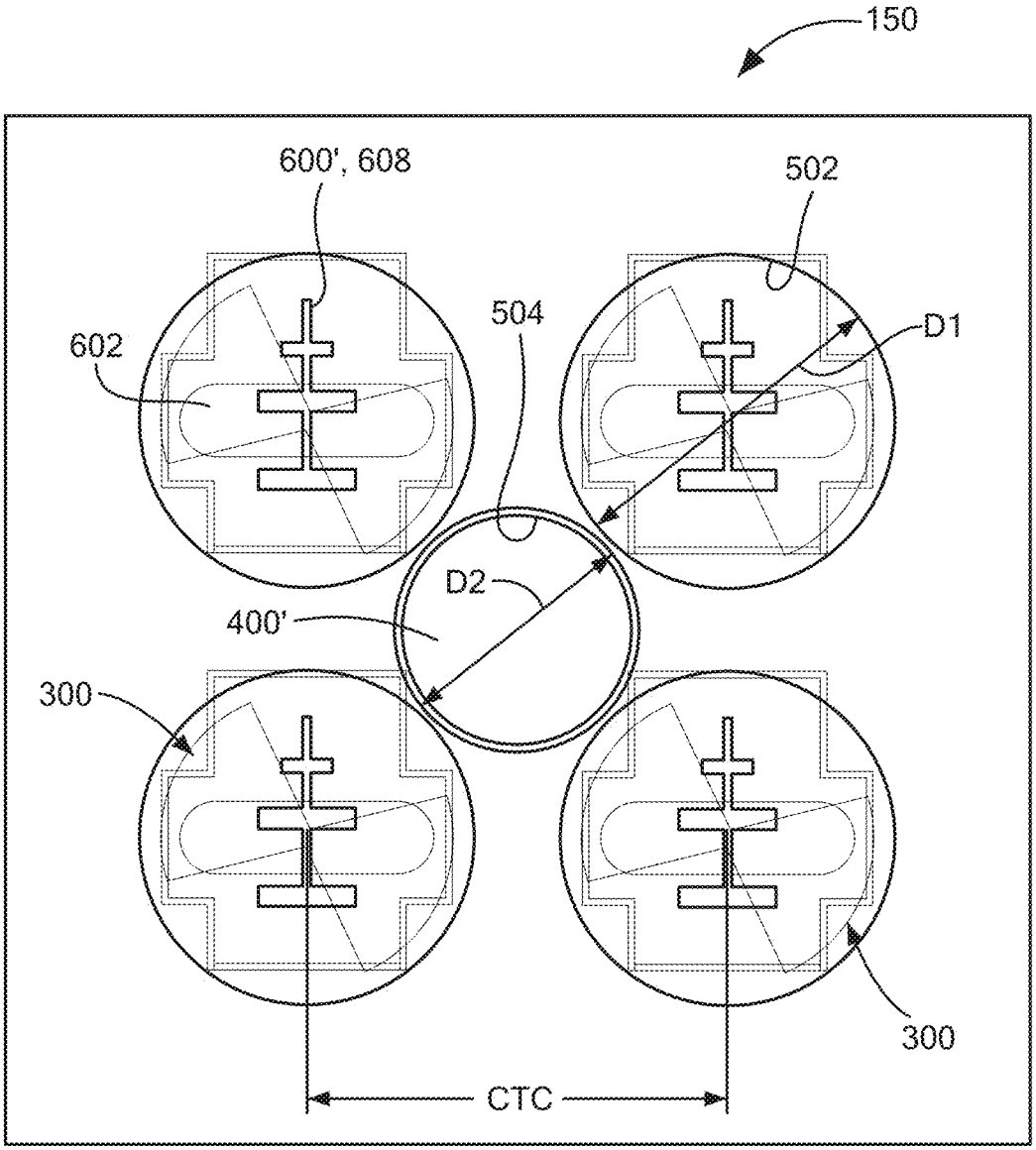
FIG. 14 depicts the embodiment of FIG. 13, but with an alternative signal feed structure, in accordance with an embodiment.

FIG. 14 depicts the embodiment of FIG. 13, but with an alternative signal feed structure 600' that includes a microstrip 608 in signal communication with the slotted aperture 602. By using a microstrip signal feed with slotted aperture in place of a signal line (stripline) feed with slotted aperture, it has been found through analytical modeling that the diameter D1 of the pocket 502 for receiving the first DRA 300 can be reduced from about 10.1 mm (see FIG. 12B) to be equal to about 8.55 mm (as depicted in FIG. 14), and the diameter D2 of the pocket 504 for receiving the second DRA 400 can be equal to about 6 mm, while maintaining the CTC spacing between adjacent first DRAs 300 equal to about λ/2, which in an embodiment is equal to about 10.7 mm at 14 GHz operating frequency.

Figure 15B:
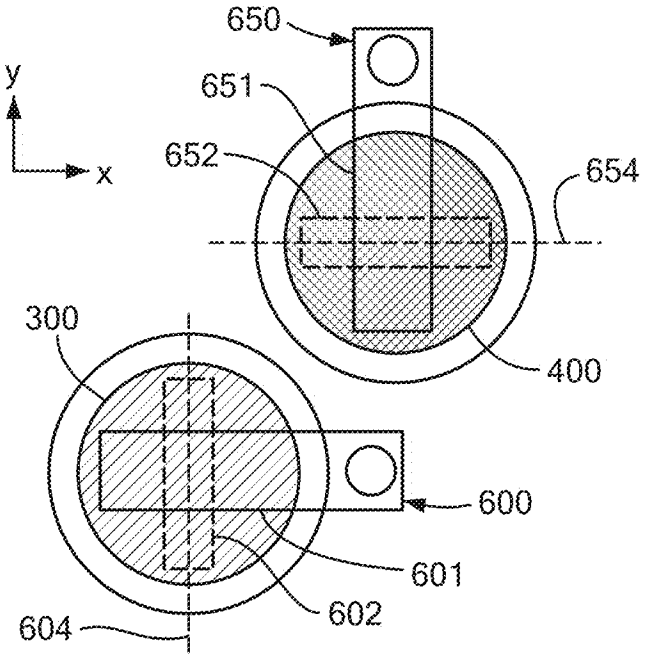
FIGS. 15A and 15B, respectively depict, a top down plan view, and alternative signal feed arrangements, of the multi-resonator array of FIG. 1, in accordance with an embodiment.
Figure 15A:
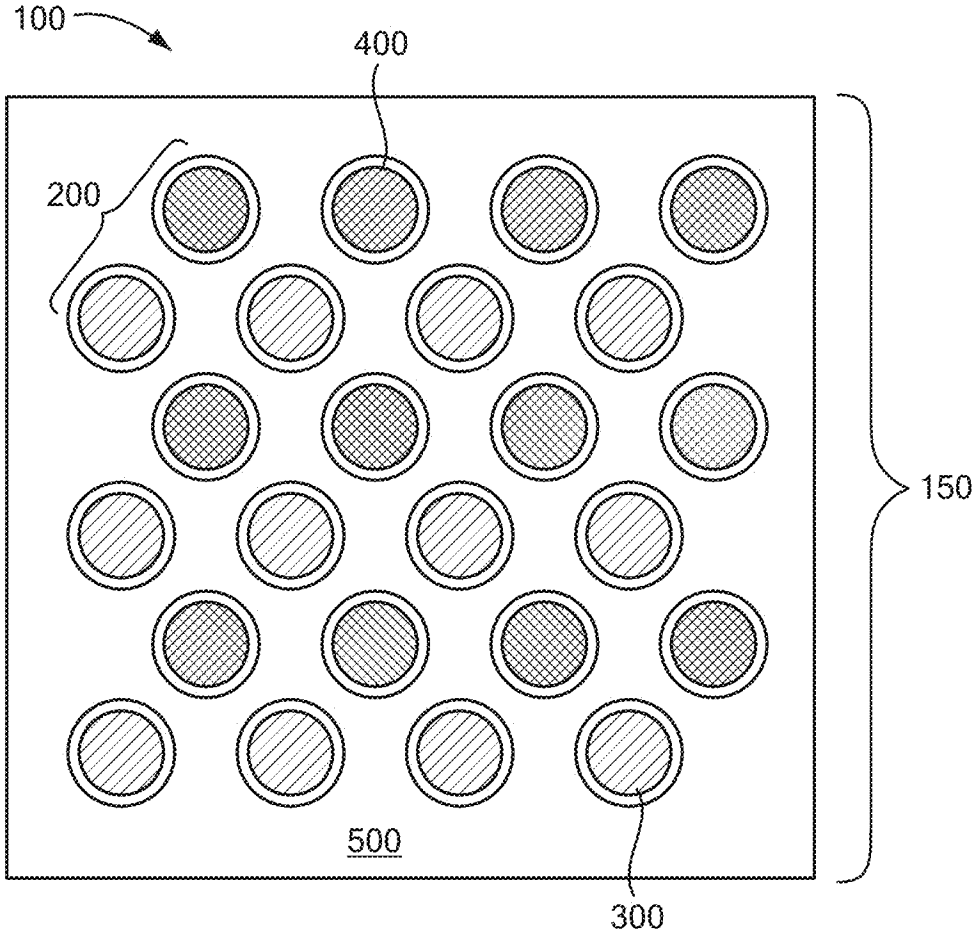
Figure 16B:
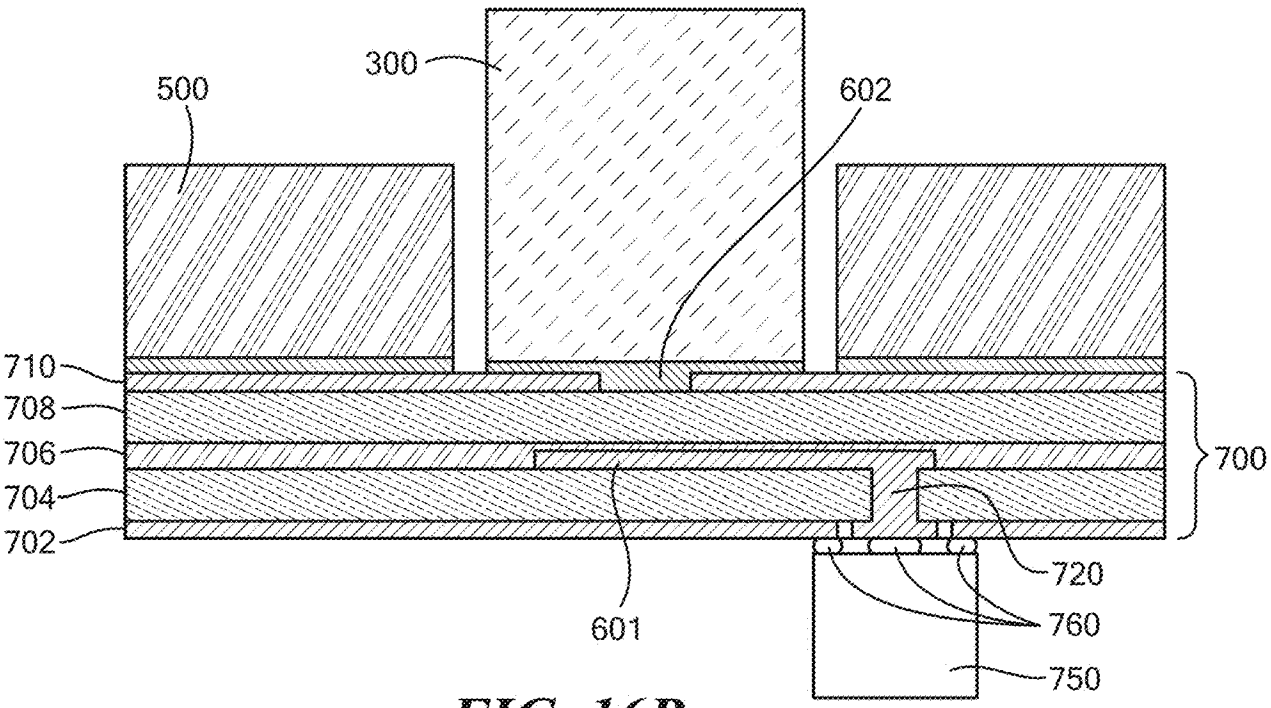
FIGS. 16A and 16B, respectively depict, a top down plan view, and a side elevation section cut view, of a first of the signal feed arrangements of FIG. 15B, in accordance with an embodiment.
Figure 16A:
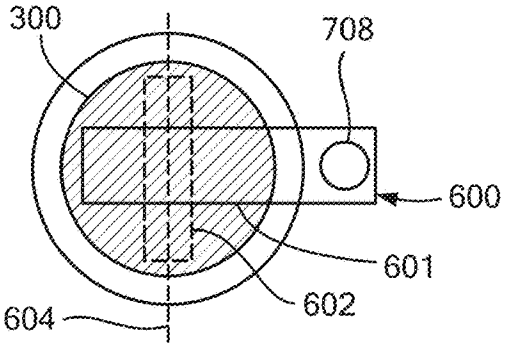

FIGS. 15A and 15B, respectively depict, a top down plan view, and alternative signal feed arrangements, of the multi-resonator array 150 of FIG. 1; FIGS. 16A and 16B, respectively depict, a top down plan view, and a side elevation section cut view, of a first of the signal feed arrangements of FIG. 15B; and, FIGS. 17A and 17B, respectively depict, a top down plan view, and a side elevation section cut view, of a second of the signal feed arrangements of FIG. 15B. In an embodiment, the first and second signal feeds 600, 650 include first and second signal feed lines 601, 651 in the form of a stripline disposed in signal communication with corresponding first and second slotted apertures 602, 652 that are orthogonally arranged with and extend across the corresponding first and second signal feed lines 601, 651. In an embodiment, the slotted aperture 602 of the first DRA 300 has a longitudinal orientation in a first direction 604, and the slotted aperture 652 of the second DRA 400 has a longitudinal orientation in a second direction 654. In an embodiment and as illustrated, the second direction 654 of the second slotted aperture 652 is orthogonal to the first direction 604 of the first slotted aperture 602.

Figure 17B:
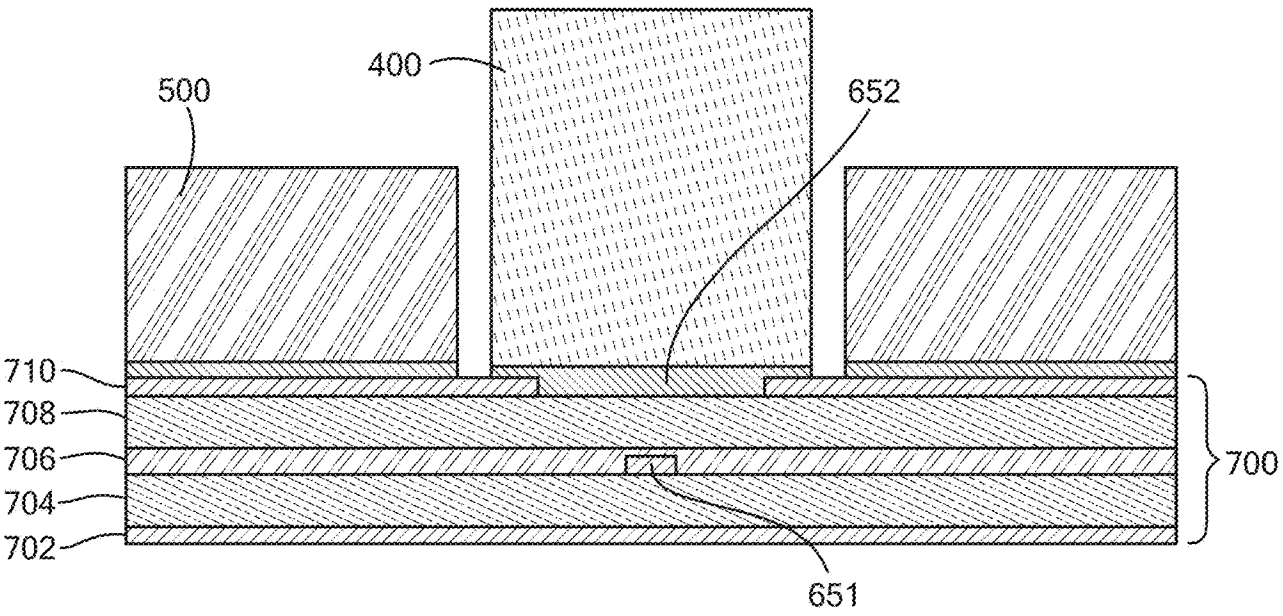
FIGS. 17A and 17B, respectively depict, a top down plan view, and a side elevation section cut view, of a second of the signal feed arrangements of FIG. 15B, in accordance with an embodiment.
Figure 17A:
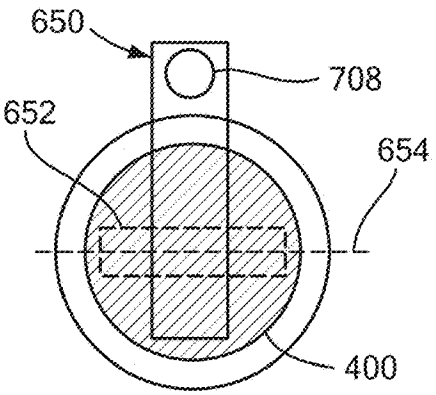

Reference is now made to FIGS. 16A, 16B, 17A and 17B, collectively, which illustrate further details of the first and second signal feeds 600, 650, where FIG. 16B depicts a side view cross section cut longitudinally through the first signal feed line 601 of FIGS. 15B and 16A, and where FIG. 17B depicts a side view cross section cut longitudinally through the second signal feed line 651 of FIGS. 15B and 17A. In an embodiment, the substrate 700 is a bonded laminate in the form of a first (lower) electrically conductive layer 702, a first (lower) radio frequency, RF, dielectric 704, an intermediate bondply 706, a second (upper) RF dielectric 708, and a second (upper) electrically conductive layer 710. In an embodiment, each of the first and second signal feed line 601, 651 is connected to a radio frequency, RF, connector 750 through an electrically conductive via 720 and a solder region 760, and the RF connector 750 is electrically connected to the first lower electrically conductive layer 702, a ground layer, through solder regions 760. As discussed herein above, by employing orthogonally arranged signal feeds 600, 650, dual polarization, LHCP and RHCP, can be achieved.

Figure 18A:
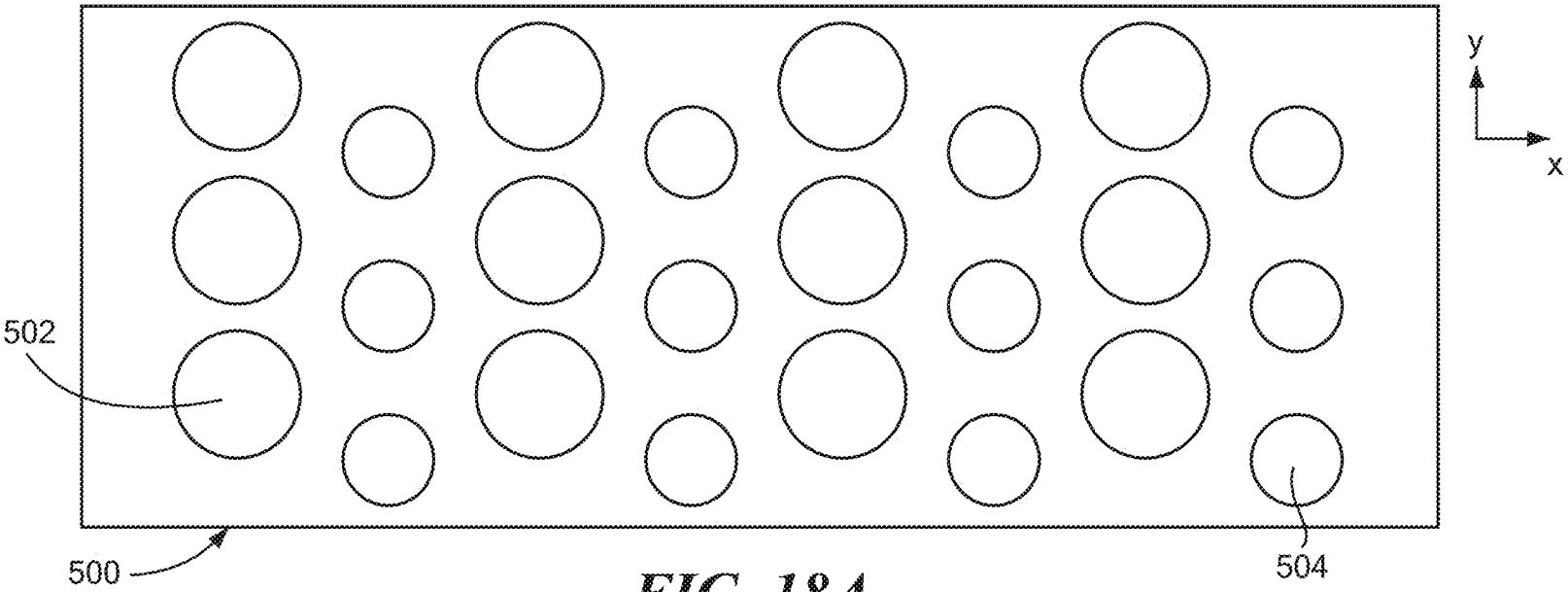
FIGS. 18A and 18B, respectively depict, a top down plan view of an EM reflector formed of a stamped metal, and a block diagram side elevation view of an EM apparatus constructed with a stamped metal EM reflector, in accordance with an embodiment.
Figure 18B:
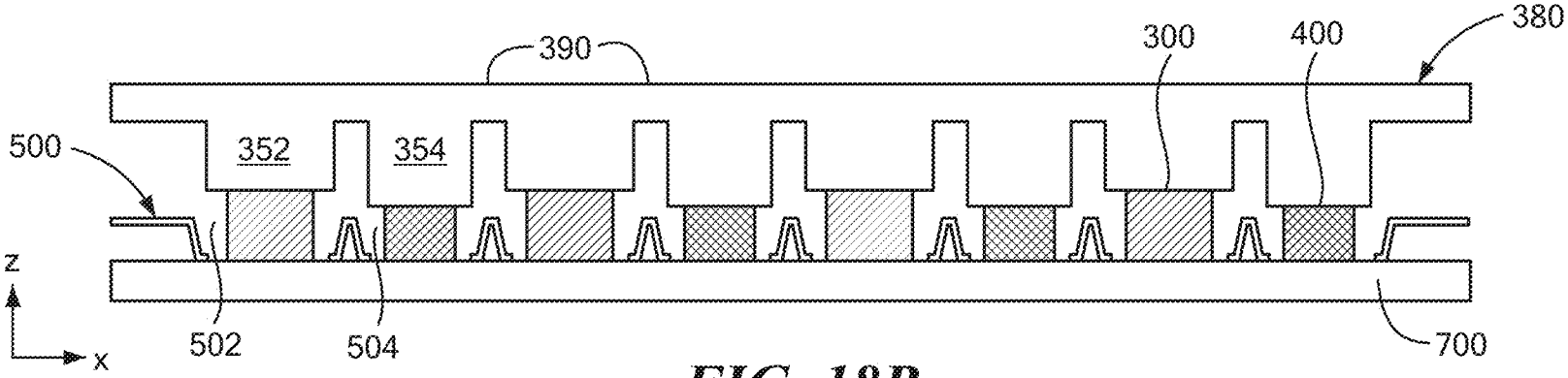

FIGS. 18A and 18B, respectively depict, a top down plan view of an EM reflector 500 formed of a stamped metal that forms the individual pockets 502, 504, and a block diagram side elevation view of an EM apparatus 100 constructed with the stamped metal EM reflector 500 of FIG. 18A. The EM apparatus 100 depicted in FIG. 18B is similar to other EM apparatuses described and depicted herein having first and second DRAs 300, 400 disposed in corresponding pockets 502, 504, but where the pockets 502, 504 are formed in the stamped metal EM reflector 500 of FIG. 18A. FIG. 18B also depicts a low Dk cover construct 380 having a plurality of first and second beam shapers 352, 354 with a relatively thin connecting structure 390 integrally formed with and interconnecting an array of the first and second beam shapers 352, 354. In an embodiment, the cover construct 380 is assembled on the first and second DRAs 300, 400 subsequent to the first and second DRAs 300, 400 being assembled in the respective pockets 502, 504. In an embodiment, the first and second DRAs 300, 400 are an extruded construct having a direction of extrusion in the z-direction. In an embodiment, the first and second beam shapers 352, 354 and the integrally formed relatively thin connecting structure 390, has a relatively lower Dk value, which in an embodiment is greater than 1 and equal to or less than 5, than the first and second DRAs 300, 400, which in an embodiment have a relatively higher Dk value that is equal to or greater than 10 and equal to or less than 20. In an embodiment, the stamped metal EM reflector 500, first and second DRAs 300, 400, and cover construct 380, are disposed on a substrate 700. While a stamped metal EM reflector 500 is depicted, it will be appreciated that other forms of fabrication for the EM reflector 500 are possible and contemplated, such as: machined solid metal; metal-plated plastic, molded or machined plastic with a plated exterior for example; metal-plated laminate with plated through holes; 3D metal printing; and, metal-plated 3D plastic printing. The EM reflector 500 may be attached to the substrate 700 using a variety of techniques such as: mechanical fasteners (screws, bolts, pressure clips, interlocking features, or press-fit features, for example); and/or material fasteners (adhesives, dry film or wet resin, with or without a ceramic filler, for example), (soldering, such as solder balls, dry film, wet paste, for example). In an embodiment, the attachment feature may be electrically conductive and thermally conductive, and in some applications and/or regions may be electrically insulative.

As used herein, the phrase relatively thin connecting structure refers to a connecting construct that is relatively thin in two dimensions of a cross section of the connecting structure as compared to an overall outside dimension of the first and second DRAs 300, 400, so that such construct of the connecting structure does not electromagnetically interfere with the performance characteristics of the EM apparatus 100.

In view of all of the foregoing, it will be appreciated that various aspects of an embodiment are disclosed herein, which are in accordance with, but not limited to, at least the following aspects and/or combinations of aspects.

Aspect 1. An electromagnetic, EM, apparatus 100, comprising: a unit cell 200 comprising at least two dielectric resonator antennas, DRAs 300, 400; wherein each one of the at least two DRAs 300, 400 is distinctly different from another one of the at least two DRAs 300, 400; wherein each one of the at least two DRAs 300, 400 is not electromagnetically coupled with another one of the at least two DRAs 300, 400; wherein the unit cell 200 is configured to operate over a defined overall frequency range; wherein a first DRA 300 of the at least two DRAs 300, 400 is configured to operate over a first frequency range within the overall frequency range; wherein a second DRA 400 of the at least two DRAs 300, 400 is configured to operate over a second frequency range within the overall frequency range that is different from the first frequency range.

Aspect 2. The EM apparatus 100 of Aspect 1, wherein: the first frequency range is equal to or greater than 10 GHz and equal to or less than 13 GHz; and the second frequency range is greater than 13 GHz and equal to or less than 15 GHz; or: the first frequency range is equal to or greater than 10 GHz and less than 13 GHz; and the second frequency range is equal to or greater than 13 GHz and equal to or less than 15 GHz.

Aspect 3. The EM apparatus 100 of any of Aspects 1 to 2, wherein: the second DRA 400 has a 3D size that is distinctly different from a 3D size of the first DRA 300.

Aspect 4. The EM apparatus 100 of any of Aspects 1 to 3, wherein: as observed in a cross section plan view of the unit cell 200, the first DRA 300 has a first dielectric portion 302, 1DP, disposed on a first side of a central axis of the first DRA 300, and a second dielectric portion 304, 2DP, disposed on a second side of the central axis of the first DRA 300 that opposes the first side, the 1DP 302 and the 2DP being integrally joined with each other at a centrally disposed necked down region 306 of the first DRA 300, wherein a direction line from a center of mass of the 1DP 302 to a center of mass of the 2DP 304 defines a first line of orientation 308 of the first DRA 300; as observed in the cross section plan view of the unit cell 200, the second DRA 400 has a third dielectric portion 402, 3DP, disposed on a first side of a central axis of the second DRA 400, and a fourth dielectric portion 404, 4DP, disposed on a second side of the central axis of the second DRA 400 that opposes the first side, the 3DP 402 and the 4DP 404 being integrally joined with each other at a centrally disposed necked down region 406 of the second DRA 400, wherein a direction line from a center of mass of the 3DP 402 to a center of mass of the 4DP 404 defines a second line of orientation 408 of the second DRA 400; and the second line of orientation 408 is not parallel with the first line of orientation 308.

Aspect 5. The EM apparatus 100 of Aspect 4, wherein: the second line of orientation 408 is perpendicular to the first line of orientation 308.

Aspect 6. The EM apparatus 100 of any of Aspects 3 to 5, wherein: as observed in a cross section plan view of the unit cell 200, the first DRA 300 has a bowtie shape, and the second DRA 400 has a bowtie shape;

Aspect 7. The EM apparatus 100 of any of Aspects 1 to 2, wherein: the second DRA 400 has a 3D shape that is distinctly different from a 3D shape of the first DRA 300.

Aspect 8. The EM apparatus 100 of any of Aspects 1 to 2, wherein: the second DRA 400 has a relative dielectric constant, Dk, that is distinctly different from a Dk of the first DRA 300.

Aspect 9. The EM apparatus 100 of any of Aspects 1 to 2, wherein: the second DRA 400 has an EM polarization that is distinctly different from an EM polarization of the first DRA 300.

Aspect 10. The EM apparatus 100 of any of Aspects 1 to 2, wherein: the first DRA 300 is configured to generate EM radiation having one of a left-hand-circular-polarization or a right-hand-circular-polarization; and the second DRA 400 is configured to generate EM radiation having the other one of the left-hand-circular-polarization or the right-hand-circular-polarization.

Aspect 11. The EM apparatus 100 of any of Aspects 1 to 10, wherein: the first DRA 300 and the second DRA 400 are at least partially encased in a common dielectric medium 220 having a third relative dielectric constant, Dk, that is less than a first Dk of the first DRA 300 and is less than a second Dk of the second DRA 400.

Aspect 12. The EM apparatus 100 of Aspect 11, wherein: the common dielectric medium 220 between the first DRA 300 and the second DRA 400 forms a relatively thin connecting structure 220 that is relatively thin compared to an overall outside dimension of each of the first DRA 300 and the second DRA 400, as observed in a plan view of the unit cell 200.

Aspect 13. The EM apparatus 100 of Aspect 12, wherein: the relatively thin connecting structure 220 is in a form of an extrusion oriented in a z-direction longitudinally and parallel with a central z-axis of the first DRA.

Aspect 14. The EM apparatus 100 of any of Aspects 1 to 13, further comprising: a first beam shaper 352 disposed on top of the first DRA 300.

Aspect 15. The EM apparatus 100 of Aspect 14, wherein: the first DRA 300 has an outside shape in a form of an extrusion oriented in a z-direction parallel with a central z-axis of the first DRA 300.

Aspect 16. The EM apparatus 100 of Aspect 15, wherein: the first beam shaper 352 has an outside shape in a form of an extrusion oriented in the z-direction parallel with the central z-axis of the first DRA 300.

Aspect 17. The EM apparatus 100 of Aspect 16, wherein: the outside shape of the first beam shaper 352 is the same as and contiguous with the outside shape of the first DRA 300.

Aspect 18. The EM apparatus 100 of any of Aspects 14 to 15, wherein: the first DRA 300 has an apex having a 3D shape; the first beam shaper 352 has an apex having a 3D shape that is different from the 3D shape of the apex of the first DRA 300.

Aspect 19. The EM apparatus 100 of Aspect 18, wherein: the 3D shape of the apex of the first DRA 300 is dome shaped; and the 3D shape of the apex of the first beam shaper 352 is not dome shaped.

Aspect 20. The EM apparatus 100 of Aspect 14, wherein: the first beam shaper 352 is integrally formed with the first DRA 300, the first beam shaper 352 having a complete or partially complete side wall 362 formed from dielectric material of the first DRA 300 that surrounds or partially surrounds an inner region 364 comprising a dielectric medium having a relative dielectric constant, Dk, that is less than the Dk of the dielectric material of the first DRA 300.

Aspect 21. The EM apparatus 100 of Aspect 20, wherein: the first beam shaper 352 has an open top 366 absent of the dielectric material of the first DRA 300.

Aspect 22. The EM apparatus 100 of any of Aspects 1 to 14, further comprising: a substrate 700 comprising at least one EM signal feed 600, 650; wherein the unit cell 200 is disposed on the substrate 700 in signal communication with the at least one EM signal feed 600.

Aspect 23. The EM apparatus 100 of Aspect 22, wherein: the at least one EM signal feed comprises a first EM signal feed 600 and a second EM signal feed 650; the first DRA 300 being disposed in signal communication with the first EM signal feed 600; and the second DRA 400 being disposed in signal communication with the second EM signal feed 650.

Aspect 24. The EM apparatus 100 of Aspect 23, further comprising: a super-substrate 500 disposed on top of the substrate 700, the super-substrate 500 comprising an electrically conductive outer surface that is electrically connected with an electrical ground 702 of the substrate 700; wherein the super-substrate 500 comprises at least one recess 502, 504 in which the unit cell 200 is at least partially disposed; and wherein the at least one recess 502, 504 has an electrically conductive inner wall that is electrically connected with the electrical ground 702 of the substrate 700 and forms an EM reflector 500.

Aspect 25. The EM apparatus 100 of Aspect 24, wherein: the at least one recess 502, 504 comprises a first recess 502 conjoined with a second recess 504 via a bridge region 508; the first DRA 300 is disposed in the first recess 502; the second DRA 400 is disposed in the second recess 504; and the bridge region 508 is formed by an absence of material of the EM reflector 500.

Aspect 26. The EM apparatus 100 of Aspect 25; wherein: the first DRA 300 and the second DRA 400 are at least partially encased in a common dielectric medium 220 having a third relative dielectric constant, Dk, that is less than a first Dk of the first DRA 300 and is less than a second Dk of the second DRA 400; the common dielectric medium 220 between the first DRA 300 and the second DRA 400 forms a relatively thin connecting structure 220 that is relatively thin compared to an overall outside dimension of each of the first DRA 300 and the second DRA 400, as observed in a plan view of the unit cell 200; and the relatively thin connecting structure 220 is disposed at the bridge region 508.

Aspect 27. The EM apparatus 100 of Aspect 24, wherein: the signal feed 600 comprises an elongated aperture 602; and the unit cell 200 only partially covers the elongated aperture 602.

Aspect 28. The EM apparatus 100 of any of Aspects 24 to 25, wherein: the first beam shaper 352 partially overhangs an upper surface of the super-substrate 500 to at least partially cover an edge of the EM reflector 500.

Aspect 29. The EM apparatus 100 of Aspect 22, wherein: the at least one EM signal feed 600 comprises a first EM signal feed 600 and a second EM signal feed 650; the first DRA 300 is disposed in signal communication with the first EM signal feed 600; and the second DRA 400 is disposed in signal communication with the second EM signal feed 650.

Aspect 30. The EM apparatus 100 of Aspect 29, wherein: the first EM signal feed 600 is oriented in a first direction 604 relative to the unit cell 200; the second EM signal feed 650 is oriented in a second direction 654 relative to the unit cell 200; and the second direction 654 is different from the first direction 604.

Aspect 31. The EM apparatus 100 of Aspect 30, wherein: the second direction 654 is orthogonal to the first direction 604.

Aspect 32. An array 150 comprising a plurality of the unit cells 200 of any of Aspects 1 to 13, the array 150 further comprising; a substrate 700; wherein the plurality of the unit cells 200 are disposed on the substrate 700.

Aspect 33. The array 150 of Aspect 32, wherein: adjacent ones of either the first DRA 300 or the second DRA 400 are integrally connected with each other via a relatively thin connecting structure 390 that is relatively thin compared to an overall outside dimension of a corresponding one of the first DRA 300 or the second DRA 400, as observed in a plan view of the unit cell 200.

Aspect 34. The array 150 of Aspect 33, wherein: the relatively thin connecting structure 390 is in a form of an extrusion oriented in a z-direction longitudinally and parallel with a central z-axis of a corresponding one of the first DRA 300 or the second DRA 400.

Aspect 35. The array 150 of any of Aspects 32 to 34, further comprising: a super-substrate 500 disposed on top of the substrate 700, the super-substrate 500 comprising an electrically conductive outer surface that is electrically connected with an electrical ground 702 of the substrate 700; wherein the super-substrate 500 comprises a plurality of recesses 502, 504 in which one of the plurality of unit cells 200 is at least partially disposed.

Aspect 36. The array 150 of Aspect 35, wherein: each recess 502, 504 of the plurality of recesses has an electrically conductive inner wall that is electrically connected with the electrical ground 702 of the substrate 700 and forms an EM reflector 500.

Aspect 37. The array 150 of any of Aspects 35 to 36, wherein: the super-substrate 500 is formed from a stamped metal.

Aspect 38. The array 150 of Aspect 32, wherein: the substrate 700 comprises a plurality of EM signal feeds 600, 650, a single one of the plurality of EM signal feeds disposed in a one-to-one correspondence with a single one of the first and second DRAs 300, 400 of the plurality of unit cells, such that each DRA of the plurality of unit cells is electromagnetically separately addressable.

Aspect 39. The array 150 of Aspect 38, wherein: each of the plurality of EM signal feeds 600, 650 comprises a slotted aperture 602, 652; the slotted aperture 602 of the first DRA 300 has a longitudinal orientation in a first direction 604; the slotted aperture 652 of the second DRA 400 has a longitudinal orientation in a second direction 654; the second direction 654 is orthogonal to the first direction 604.

Aspect 40. The array 150 of any of Aspects 36 to 37, wherein: the substrate 700 comprises a plurality of EM signal feeds 600, 650, a single one of the plurality of EM signal feeds disposed in a one-to-one correspondence with a single one of the first and second DRAs 300, 400 of the plurality of unit cells 200; each of the plurality of EM signal feeds 600, 650 comprises a slotted aperture 602, 652; the corresponding slotted aperture 602 of the first DRA 300 has a longitudinal orientation in a first direction 604; the corresponding slotted aperture 652 of the second DRA 400 has a longitudinal orientation in a second direction 654; the second direction 654 is orthogonal to the first direction 604; the first DRA 300 comprises a first planer surface 312 disposed parallel with the first direction 604, the first planer surface 312 of the first DRA 300 is disposed in contact with an electrically conductive planer surface 512 of the corresponding recess 502 of the super-substrate 500; the second DRA 400 comprises a second planer surface 412 disposed parallel with the second direction 654, the second planer surface 412 of the second DRA 400 is disposed in contact with an electrically conductive planer surface 514 of the corresponding recess 504 of the super-substrate 500.

Aspect 41. The array 150 of Aspect 40, wherein: the first DRA 300 completely covers the first slotted aperture 602; and the second DRA 400 completely covers the second slotted aperture 652.

Aspect 42. The array 150 of any of Aspects 40 to 41, wherein: the first planer surface 312 of the first DRA 300 is disposed at an edge 606 of the first slotted aperture 602; and the second planer surface 412 of the second DRA 400 is disposed at an edge 656 of the second slotted aperture 652.

In view of all of the foregoing, it will be appreciated that a multi-resonator array having DRAs as disclosed herein suitable for dual frequency operation with different polarization modes would be advantageous for use in a phased array having a compact design.

As used herein, the phrase "equal to about" is intended to account for manufacturing tolerances and/or insubstantial deviations from a nominal value that do not detract from a purpose disclosed herein and falling within a scope of the appended claims.

While certain combinations of individual features have been described and illustrated herein, it will be appreciated that these certain combinations of features are for illustration purposes only and that any combination of any of such individual features may be employed in accordance with an embodiment, whether or not such combination is explicitly illustrated, and consistent with the disclosure herein. Any and all such combinations of features as disclosed herein are contemplated herein, are considered to be within the understanding of one skilled in the art when considering the application as a whole, and are considered to be within the scope of the invention disclosed herein, as long as they fall within the scope of the invention defined by the appended claims, in a manner that would be understood by one skilled in the art.

While an invention has been described herein with reference to example embodiments, it will be understood by those skilled in the art that various changes may be made and equivalents may be substituted for elements thereof without departing from the scope of the claims. Many modifications may be made to adapt a particular situation or material to the teachings of the invention without departing from the essential scope thereof. Therefore, it is intended that the invention not be limited to the particular embodiment or embodiments disclosed herein as the best or only mode contemplated for carrying out this invention, but that the invention will include all embodiments falling within the scope of the appended claims. In the drawings and the description, there have been disclosed example embodiments and, although specific terms and/or dimensions may have been employed, they are unless otherwise stated used in a generic, exemplary and/or descriptive sense only and not for purposes of limitation, the scope of the claims therefore not being so limited. When an element such as a layer, film, region, substrate, or other described feature is referred to as being "on" or in "engagement with" another element, it can be directly on or engaged with the other element, or intervening elements may also be present. In contrast, when an element is referred to as being "directly on" or "directly engaged with" another element, there are no intervening elements present. The use of the terms first, second, etc. do not denote any order or importance, but rather the terms first, second, etc. are used to distinguish one element from another. The use of the terms a, an, etc. do not denote a limitation of quantity, but rather denote the presence of at least one of the referenced item. The term "comprising" as used herein does not exclude the possible inclusion of one or more additional features. And, any background information provided herein is provided to reveal information believed by the applicant to be of possible relevance to the invention disclosed herein. No admission is necessarily intended, nor should be construed, that any of such background information constitutes prior art against an embodiment of the invention disclosed herein.

The invention claimed is:

1. An electromagnetic, EM, apparatus, comprising:

a unit cell comprising at least two dielectric resonator antennas, DRAs;

wherein each one of the at least two DRAs is distinctly different from another one of the at least two DRAs;

wherein each one of the at least two DRAs is not electromagnetically coupled with another one of the at least two DRAs;

wherein the unit cell is configured to operate over a defined overall frequency range;

wherein a first DRA of the at least two DRAs is configured to operate over a first frequency range within the overall frequency range;

wherein a second DRA of the at least two DRAs is configured to operate over a second frequency range within the overall frequency range that is different from the first frequency range;

wherein as observed in a plan view of the unit cell, the first DRA has a first dielectric portion, 1DP, disposed on a first side of a central axis of the first DRA, and a second dielectric portion, 2DP, disposed on a second side of the central axis of the first DRA that opposes the first side, the 1DP and the 2DP being integrally joined with each other at a centrally disposed necked down region of the first DRA, wherein a direction line from a center of mass of the 1DP to a center of mass of the 2DP defines a first line of orientation of the first DRA;

wherein as observed in the plan view of the unit cell, the second DRA has a third dielectric portion, 3DP, disposed on a first side of a central axis of the second DRA, and a fourth dielectric portion, 4DP, disposed on a second side of the central axis of the second DRA that opposes the first side, the 3DP and the 4DP being integrally joined with each other at a centrally disposed necked down region of the second DRA, wherein a direction line from a center of mass of the 3DP to a center of mass of the 4DP defines a second line of orientation of the second DRA; and the second line of orientation is perpendicular to the first line of orientation.

2. The EM apparatus of claim 1, wherein:

the first frequency range is equal to or greater than 10 GHz and equal to or less than 13 GHz; and the second frequency range is greater than 13 GHz and equal to or less than 15 GHz;

or:

the first frequency range is equal to or greater than 10 GHz and less than 13 GHz; and the second frequency range is equal to or greater than 13 GHz and equal to or less than 15 GHz.

3. The EM apparatus of claim 1, wherein:

the second DRA has a 3D size that is distinctly different from a 3D size of the first DRA.

4. The EM apparatus of claim 1, wherein:

the second DRA has a relative dielectric constant, Dk, that is distinctly different from a Dk of the first DRA.

5. The EM apparatus of claim 1, wherein:

the second DRA has an EM polarization that is distinctly different from an EM polarization of the first DRA.

6. The EM apparatus of claim 1, wherein:

the first DRA is configured to generate EM radiation having one of a left-hand-circular-polarization or a right-hand-circular-polarization; and the second DRA is configured to generate EM radiation having the other one of the left-hand-circular-polarization or the right-hand-circular-polarization.

7. The EM apparatus of claim 1, further comprising:

a first beam shaper disposed on top of the first DRA.

8. The EM apparatus of claim 7, wherein:

the first DRA has an outside shape in a form of an extrusion oriented in a z-direction parallel with a central z-axis of the first DRA.

9. The EM apparatus of claim 8, wherein:

the first beam shaper has an outside shape in a form of an extrusion oriented in the z-direction parallel with the central z-axis of the first DRA.

10. The EM apparatus of claim 1, further comprising:

a substrate comprising at least one EM signal feed;

wherein the unit cell is disposed on the substrate in signal communication with the at least one EM signal feed.

11. The EM apparatus of claim 10, wherein:

the at least one EM signal feed comprises a first EM signal feed and a second EM signal feed;

the first DRA is disposed in signal communication with the first EM signal feed; and the second DRA is disposed in signal communication with the second EM signal feed.

12. The EM apparatus of claim 11, wherein:

the first EM signal feed is oriented in a first direction relative to the unit cell;

the second EM signal feed is oriented in a second direction relative to the unit cell; and the second direction is different from the first direction.

13. The EM apparatus of claim 12, wherein:

the second direction is orthogonal to the first direction.

14. An array comprising a plurality of the unit cells of claim 1, the array further comprising;

a substrate;

wherein the plurality of the unit cells are disposed on the substrate.

15. An array comprising a plurality of unit cells, each unit cell comprising at least two dielectric resonator antennas, DRAs, wherein each one of the at least two DRAs is distinctly different from another one of the at least two DRAs, wherein each one of the at least two DRAs is not electromagnetically coupled with another one of the at least two DRAs, wherein the unit cell is configured to operate over a defined overall frequency range, wherein a first DRA of the at least two DRAs is configured to operate over a first frequency range within the overall frequency range, wherein a second DRA of the at least two DRAs is configured to operate over a second frequency range within the overall frequency range that is different from the first frequency range;

the array further comprising;

a substrate;

wherein the plurality of the unit cells are disposed on the substrate; and wherein adjacent ones of either the first DRA or the second DRA are integrally connected with each other via a relatively thin connecting structure that is relatively thin compared to an overall outside dimension of a corresponding one of the first DRA or the second DRA, as observed in a plan view of the unit cell.

16. The array of claim 14, wherein:

the substrate comprises a plurality of EM signal feeds, a single one of the plurality of EM signal feeds disposed in a one-to-one correspondence with a single one of the first and second DRAs of the plurality of unit cells, such that each DRA of the plurality of unit cells is electromagnetically separately addressable.

17. The array of claim 16, wherein:

each of the plurality of EM signal feeds comprises a slotted aperture;

the slotted aperture of the first DRA has a longitudinal orientation in a first direction;

the slotted aperture of the second DRA has a longitudinal orientation in a second direction;

the second direction is orthogonal to the first direction.

* * * * *